US005421087A

United States Patent [19]

Newkirk et al.

[11] Patent Number: 5,421,087

[45] Date of Patent: Jun. 6, 1995

[54] METHOD OF ARMORING A VEHICLE WITH AN ANTI-BALLISTIC MATERIAL

[75] Inventors: Marc S. Newkirk; Andrew W. Urquhart, both of Newark, Del.

[73] Assignee: Lanxide Technology Company, LP, Newark, Del.

[21] Appl. No.: 998,752

[22] Filed: Dec. 30, 1992

Related U.S. Application Data

[63] Continuation of Ser. No. 428,972, Oct. 30, 1989, abandoned.

[51] Int. Cl.[6] ..... B60R 27/00

[52] U.S. Cl. ..... 29/897.2; 296/188; 428/614

[58] Field of Search ..... 420/528; 148/437–440; 428/614; 29/897.2; 296/188

[56] References Cited

U.S. PATENT DOCUMENTS

| | | | |
|---|---|---|---|
| 2,793,949 | 5/1957 | Imich | 420/528 |
| 3,616,115 | 10/1971 | Klimmet | 428/614 |
| 3,718,441 | 2/1973 | Landingham | 29/182.1 |
| 3,725,015 | 4/1973 | Weaver | 29/182.1 |
| 3,826,172 | 7/1974 | Dawson | 428/614 |
| 3,857,744 | 12/1974 | Moss | 156/60 |
| 4,030,427 | 6/1977 | Goldstein | 109/82 |
| 4,415,632 | 11/1983 | Luhleich et al. | 428/408 |
| 4,608,318 | 8/1986 | Makrides et al. | 428/614 |
| 4,710,348 | 12/1987 | Brupbacher et al. | 420/129 |
| 4,871,008 | 10/1989 | Dwivedi et al. | 164/6 |
| 4,876,941 | 10/1989 | Barnes et al. | 109/82 |
| 4,935,055 | 6/1990 | Aghajanian et al. | 164/66.1 |
| 5,008,159 | 4/1991 | Higgins et al. | 428/614 |

FOREIGN PATENT DOCUMENTS

| | | |
|---|---|---|
| 0204319 | 12/1986 | European Pat. Off. . |
| 0205084 | 12/1986 | European Pat. Off. . |
| 0206647 | 12/1986 | European Pat. Off. . |
| 0207314 | 1/1987 | European Pat. Off. . |
| 0213615 | 3/1987 | European Pat. Off. . |
| 0223081 | 5/1987 | European Pat. Off. . |
| 0223478 | 5/1987 | European Pat. Off. . |
| 0228079 | 7/1987 | European Pat. Off. . |
| 0240251 | 10/1987 | European Pat. Off. . |
| 0241198 | 10/1987 | European Pat. Off. . |
| 0256600 | 2/1988 | European Pat. Off. . |
| 0280875 | 9/1988 | European Pat. Off. . |
| 0299483 | 1/1989 | European Pat. Off. . |
| 0375588 | 6/1990 | European Pat. Off. . |
| 62-93323 | 4/1987 | Japan . |
| 63-238227 | 10/1988 | Japan . |
| 1-36734 | 2/1989 | Japan . |
| 1-83634 | 3/1989 | Japan . |
| 1-212729 | 8/1989 | Japan . |

*Primary Examiner*—George Wyszomierski
*Attorney, Agent, or Firm*—Mark G. Mortenson; Jeffrey R. Ramberg; Kevin J. Boland

[57] ABSTRACT

The present invention relates to a method of armoring a vehicle with a novel armor material. Particularly, a metal matrix composite body is formed with a filler material and an aluminum matrix metal, wherein the filler material comprises magnesia or titanium diboride and is present in an amount of at least 40 percent by volume. The metal matrix composite body is then placed on a portion of a vehicle.

2 Claims, 2 Drawing Sheets

METHOD OF ARMORING A VEHICLE WITH AN ANTI-BALLISTIC MATERIAL

This is a continuation of application Ser. No. 07/428,972 filed on Oct. 30, 1989, abandoned.

FIELD OF INVENTION

The present invention relates to novel composite materials and methods for making the same. Specifically, these novel composite materials can be used as armor material.

BACKGROUND OF THE INVENTION

The prior art is replete with many different approaches for producing armor materials. Specifically, numerous attempts have been made to make metallic armor and ceramic armor, as well as composite armor. However, a need still exists to produce a reliable armor material which is relatively inexpensive and simple to make.

Conventional armor systems also involve laminated structures which include various materials such as metal, ceramics, and/or composite layers. However, a need still exists to provide better armor materials having desirable anti-ballistic performance, which can be made at low cost, and involving simple manufacturing techniques.

DISCUSSION OF RELATED COMMONLY-OWNED PATENTS AND PATENT APPLICATIONS

A novel method of forming a metal matrix composite by infiltration of a permeable mass of filler contained in a ceramic matrix composite mold is disclosed in Commonly Owned U.S. Pat. No. 4,871,008, which issued on Oct. 3, 1989, from U.S. patent application Ser. No. 142,385, filed Jan. 11, 1988, by Dwivedi et al., and entitled "Method of Making Metal Matrix Composites". According to the method of the Dwivedi et al. invention, a mold is formed by the directed oxidation of a molten precursor metal or parent metal with an oxidant to develop or grow a polycrystalline oxidation reaction product which embeds at least a portion of a preform comprised of a suitable filler (referred to as a "first filler"). The formed mold of ceramic matrix composite is then provided with a second filler and the second filler and mold are contacted with molten metal, and the mold contents are hermetically sealed, most typically by introducing at least one molten metal into the entry or opening which seals the mold. The hermetically sealed bedding may contain entrapped air, but the entrapped air and the mold contents are isolated or sealed so as to exclude or shut-out the external or ambient air. By providing a hermetic environment, effective infiltration of the second filler at moderate molten metal temperatures is achieved, and therefore obviates or eliminates any necessity for wetting agents, special alloying ingredients in the molten matrix metal, applied mechanical pressure, applied vacuum, special gas atmospheres or other infiltration expedients.

The method of Dwivedi et al., was improved upon by Kantner et al., in commonly owned U.S. patent application Ser. No. 07/381,523, filed Jul. 18, 1989, and entitled "A Method of Forming Metal Matrix Composite Bodies By a Self-Generated Vacuum Process, and Products Produced Therefrom", which was abandoned in favor of Continuation Application Ser. No. 888,241, which was filed on May 22, 1992, now U.S. Pat. No. 5,224,533, which issued on Jul. 6, 1993. According to the method of Kantner et al., an impermeable container is fabricated and a filler material or preform is placed inside the container. A matrix metal is then made molten and placed into contact with the filler material or preform. A sealing means is then formed to isolate any ambient atmosphere from the reactive atmosphere contained within the filler material or preform. A self-generated vacuum is then formed within the container which results in molten matrix metal infiltrating the filler material or preform. The matrix metal is thereafter cooled (e.g., directionally solidified) and the formed metal matrix composite body is removed from the container. Kantner et al., disclose a number of different matrix metal and filler material combinations which are suitable for use with the invention disclosed therein.

The subject matter of this application is also related to that of several other copending and co-owned metal matrix composite patent applications. Specifically, a novel method of making a metal matrix composite material is disclosed in Commonly Owned U.S. patent application Ser. No. 049,171, filed May 13, 1987, in the names of White et al., and entitled "Metal Matrix Composites", now U.S. Pat. No. 4,828,008, which issued on May 9, 1989. According to the method of the White et al. invention, a metal matrix composite is produced by infiltrating a permeable mass of filler material (e.g., a ceramic or a ceramic-coated material) with molten aluminum containing at least about 1 percent by weight magnesium, and preferably at least about 3 percent by weight magnesium. Infiltration occurs spontaneously without the application of external pressure or vacuum. A supply of the molten metal alloy is contacted with the mass of filler material at a temperature of at least about 675° C. in the presence of a gas comprising from about 10 to 100 percent, and preferably at least about 50 percent, nitrogen by volume, and a remainder of the gas, if any, being a nonoxidizing gas, e.g., argon. Under these conditions, the molten aluminum alloy infiltrates the ceramic mass under normal atmospheric pressures to form an aluminum (or aluminum alloy) matrix composite. When the desired amount of filler material has been infiltrated with the molten aluminum alloy, the temperature is lowered to solidify the alloy, thereby forming a solid metal matrix structure that embeds the reinforcing filler material. Usually, and preferably, the supply of molten alloy delivered will be sufficient to permit the infiltration to proceed essentially to the boundaries of the mass of filler material. The amount of filler material in the aluminum matrix composites produced according to the White et al. invention may be exceedingly high. In this respect, filler to alloy volumetric ratios of greater than 1:1 may be achieved.

Under the process conditions in the aforesaid White et al. invention, aluminum nitride can form as a discontinuous phase dispersed throughout the aluminum matrix. The amount of nitride in the aluminum matrix may vary depending on such factors as temperature, alloy composition, gas composition and filler material. Thus, by controlling one or more such factors in the system, it is possible to tailor certain properties of the composite. For some end use applications, however, it may be desirable that the composite contain little or substantially no aluminum nitride.

It has been observed that higher temperatures favor infiltration but render the process more conducive to nitride formation. The White et al. invention allows the choice of a balance between infiltration kinetics and nitride formation.

An example of suitable barrier means for use with metal matrix composite formation is described in Commonly Owned U.S. patent application Ser. No. 141,642, filed Jan. 7, 1988, in the names of Michael K. Aghajanian et al., and entitled "Method of Making Metal Matrix Composite with the Use of a Barrier", now U.S. Pat. No. 4,935,055, which issued on Jun. 19, 1990. According to the method of this Aghajanian et al. invention, a barrier means (e.g., particulate titanium diboride or a graphite material such as a flexible graphite foil product sold by Union Carbide under the trade name GRAFOIL®) is disposed on a defined surface boundary of a filler material and matrix alloy infiltrates up to the boundary defined by the barrier means. The barrier means is used to inhibit, prevent, or terminate infiltration of the molten alloy, thereby providing net, or near net, shapes in the resultant metal matrix composite. Accordingly, the formed metal matrix composite bodies have an outer shape which substantially corresponds to the inner shape of the barrier means.

The method of U.S. Pat. No. 4,828,008 was improved upon by Commonly Owned U.S. patent application Ser. No. 168,284, filed Mar. 15, 1988, in the names of Michael K. Aghajanian and Marc S. Newkirk and entitled "Metal Matrix Composites and Techniques for Making the Same". U.S. patent application Ser. No. 168,284 was abandoned in favor of U.S. Continuation Application Ser. No. 517,541, which was filed on Apr. 24, 1990, with the same inventors and title. U.S. patent application Ser. No. 517,541 was likewise abandoned in favor of Continuation Application Ser. No. 759,745, which was filed on Sep. 12, 1991, and which was abandoned in favor of Continuation Application Ser. No. 994,064, which was filed on Dec. 18, 1992, and which issued as U.S. Pat. No. 5,298,339 on Mar. 29, 1994. In accordance with the methods disclosed in this U.S. Patent, a matrix metal alloy is present as a first source of metal and as a reservoir of matrix metal alloy which communicates with the first source of molten metal due to, for example, gravity flow. Particularly, under the conditions described in this patent application, the first source of molten matrix alloy begins to infiltrate the mass of filler material under normal atmospheric pressures and thus begins the formation of a metal matrix composite. The first source of molten matrix metal alloy is consumed during its infiltration into the mass of filler material and, if desired, can be replenished, preferably by a continuous means, from the reservoir of molten matrix metal as the spontaneous infiltration continues. When a desired amount of permeable filler has been spontaneously infiltrated by the molten matrix alloy, the temperature is lowered to solidify the alloy, thereby forming a solid metal matrix structure that embeds the reinforcing filler material. It should be understood that the use of a reservoir of metal is simply one embodiment of the invention described in this patent application and it is not necessary to combine the reservoir embodiment with each of the alternate embodiments of the invention disclosed therein, some of which could also be beneficial to use in combination with the present invention.

The reservoir of metal can be present in an amount such that it provides for a sufficient amount of metal to infiltrate the permeable mass of filler material to a predetermined extent. Alternatively, an optional barrier means can contact the permeable mass of filler on at least one side thereof to define a surface boundary.

Moreover, while the supply of molten matrix alloy delivered should be at least sufficient to permit spontaneous infiltration to proceed essentially to the boundaries (e.g., barriers) of the permeable mass of filler material, the amount of alloy present in the reservoir could exceed such sufficient amount so that not only will there be a sufficient amount of alloy for complete infiltration, but excess molten metal alloy could remain and be attached to the metal matrix composite body. Thus, when excess molten alloy is present, the resulting body will be a complex composite body (e.g., a macrocomposite), wherein an infiltrated ceramic body having a metal matrix therein will be directly bonded to excess metal remaining in the reservoir.

Further improvements in metal matrix technology can be found in commonly owned U.S. patent application Ser. No. 07/416,327, filed Oct. 6, 1989 (and now abandoned), in the names of Aghajanian et al. and entitled "A Method of Forming Metal Matrix Composite Bodies By A Spontaneous Infiltration Process, and Products Produced Therefrom". According to this Aghajanian et al. invention, spontaneous infiltration of a matrix metal into a permeable mass of filler material or preform is achieved by use of an infiltration enhancer and/or an infiltration enhancer precursor and/or an infiltrating atmosphere which are in communication with the filler material or preform, at least at some point during the process, which permits molten matrix metal to spontaneously infiltrate the filler material or preform. Aghajanian et al. disclose a number of matrix metal/infiltration enhancer precursor/infiltrating atmosphere systems which exhibit spontaneous infiltration. Specifically, Aghajanian et al. disclose that spontaneous infiltration behavior has been observed in the aluminum/magnesium/nitrogen system; the aluminum/strontium/nitrogen system; the aluminum/zinc/oxygen system; and the aluminum/calcium/nitrogen system. However, it is clear from the disclosure set forth in the Aghajanian et al. invention that the spontaneous infiltration behavior should occur in other matrix metal/infiltration enhancer precursor/infiltrating atmosphere systems.

Each of the above-discussed commonly owned patent applications and patents describes methods for the production of metal matrix composite bodies and novel metal matrix composite bodies which are produced therefrom. The entire disclosures of all of the foregoing commonly owned metal matrix patent applications are expressly incorporated herein by reference.

SUMMARY OF THE INVENTION

The present invention relates to armor materials which comprise a metal matrix composite. Specifically, the armor materials may consist essentially of the metal matrix composite per se, or the metal matrix composite may be part of a subsystem for use in an armor system (e.g., for use in ground vehicles, aircraft and water vehicles).

Specifically, it has been discovered that a highly loaded metal matrix composite body (i.e., a body which has a high volume percent of a filler material contained within a matrix metal) may exhibit desirable armor characteristics. Specifically, a highly loaded metal matrix composite body may exhibit erosive effects upon a projectile; typically, has a much higher stiffness than the matrix metal alone; is harder than the matrix metal alone and may exhibit hardnesses which approach the hardnesses of the filler materials; and may have a relatively high mechanical strength.

Accordingly, any appropriate formation process which can be used to manufacture a highly loaded metal matrix composite body would be compatible with the present invention. Additionally, any combination of filler materials and matrix metals which exhibit desirable anti-ballistic performance may be combined. For example, techniques such as squeeze casting, pressure casting, etc., may be utilized to form metal matrix composite bodies according to the present invention.

However, two preferred embodiments for forming metal matrix composite bodies are disclosed herein. These two preferred embodiments have been discussed generally above herein in the section entitled "Discussion of Related Commonly Owned Patents and Patent Applications". Stated more specifically, each of the self-generated vacuum and spontaneous infiltration techniques can be used to manufacture composite bodies which exhibit desirable characteristics.

As discussed-above, any combination of metals and filler materials which exhibit desirable anti-ballistic performance can be used. However, preferred matrix metals include copper, titanium, iron, cast iron, aluminum, nickel, steel, etc. Preferred filler materials include silicon carbide, alumina, titanium diboride, zirconia, titanium carbide, titanium nitride, aluminum nitride, etc. The filler material can be in any desired shape including particles, fibers, whiskers, etc.

Especially preferred matrix metals include copper, titanium, cast iron, and aluminum in combination with the preferred filler materials of silicon carbide and alumina.

DEFINITIONS

"Alloy Side", as used herein, refers to that side of a metal matrix composite which initially contacted molten matrix metal before that molten metal infiltrated the permeable mass of filler material or preform.

"Aluminum", as used herein, means and includes essentially pure metal (e.g., a relatively pure, commercially available unalloyed aluminum) or other grades of metal and metal alloys such as the commercially available metals having impurities and/or alloying constituents such as iron, silicon, copper, magnesium, manganese, chromium, zinc, etc., therein. An aluminum alloy for purposes of this definition is an alloy or intermetallic compound in which aluminum is the major constituent.

"Ambient Atmosphere,", as used herein, refers to the atmosphere outside the filler material or preform and the impermeable container. It may have substantially the same constituents as the reactive atmosphere, or it may have different constituents.

"Balance Non-Oxidizing Gas", as used herein, means that any gas present in addition to the primary gas comprising the infiltrating atmosphere, is either an inert gas or a reducing gas which is substantially non-reactive with the matrix metal under the process conditions. Any oxidizing gas which may be present as an impurity in the gas(es) used should be insufficient to oxidize the matrix metal to any substantial extent under the process conditions.

"Barrier" or "barrier means", as used herein, means any suitable means which interferes, inhibits, prevents or terminates the migration, movement, or the like, of molten matrix metal beyond a surface boundary of a permeable mass of filler material or preform, where such surface boundary is defined by said barrier means. Suitable barrier means may be any such material, compound, element, composition, or the like, which, under the process conditions, maintains some integrity and is not substantially volatile (i.e., the barrier material does not volatilize to such an extent that it is rendered non-functional as a barrier).

Further, suitable "barrier means" includes materials which are substantially non-wettable by the migrating molten matrix metal under the process conditions employed. A barrier of this type appears to exhibit substantially little or no affinity for the molten matrix metal, and movement beyond the defined surface boundary of the mass of filler material or preform is prevented or inhibited by the barrier means. The barrier reduces any final machining or grinding that may be required and defines at least a portion of the surface of the resulting metal matrix composite product. The barrier may in certain cases be permeable or porous, or rendered permeable by, for example, drilling holes or puncturing the barrier, to permit gas to contact the molten matrix metal, etc.

"Bronze", as used herein, means and includes a copper rich alloy, which may include iron, tin, zinc, aluminum, silicon, beryllium, magnesium and/or lead. Specific bronze alloys include those alloys in which the proportion of copper is about 90% by weight, the proportion of silicon is about 6% by weight, and the proportion of iron is about 3% by weight.

"Carcass" or "Carcass of Matrix Metal", as used herein, refers to any of the original body of matrix metal remaining which has not been consumed during formation of the metal matrix composite body, and typically, if allowed to cool, remains in at least partial contact with the metal matrix composite body which has been formed. It should be understood that the carcass may also include a second or foreign metal therein.

"Cast Iron", as used herein, refers to the family of cast ferrous alloys wherein the proportion of carbon is at least about 2% by weight.

"Copper", as used herein, refers to the commercial grades of the substantially pure metal, e.g., 99% by weight copper with varying amounts of impurities contained therein. Moreover, it also refers to metals which are alloys or intermetallics which do not fall within the definition of bronze, and which contain copper as the major constituent therein.

"Filler", as used herein, is intended to include either single constituents or mixtures of constituents which are substantially non-reactive with and/or of limited solubility in the matrix metal and may be single or multiphase. Fillers may be provided in a wide variety of forms and sizes, such as powders, flakes, platelets, microspheres, whiskers, bubbles, etc., and may be either dense or porous. "Filler" may also include ceramic fillers, such as alumina or silicon carbide as fibers, chopped fibers, particulates, whiskers, bubbles, spheres, fiber mats, or the like, and ceramic-coated fillers such as carbon fibers coated with alumina or silicon carbide to protect the carbon from attack, for example, by a molten aluminum parent metal. Fillers may also include metals.

"Hot-Topping", as used herein, refers to the placement of a substance on one end (the "topping" end) of an at least partially formed metal matrix composite which reacts exothermally above and/or with at least one of the matrix metal and/or filler material and/or with another material supplied to the topping end. This exothermic reaction should provide sufficient heat to maintain the matrix metal at the topping end in a molten state while the balance of the matrix metal in the composite cools to solidification temperature.

"Impermeable Container", as used herein, means a container which may house or contain a reactive atmosphere and a filler material (or preform) and/or molten matrix metal and/or a sealing means under the process conditions, and which is sufficiently impermeable to the transport of gaseous or vapor species through the container, such that a pressure difference between the ambient atmosphere and the reactive atmosphere can be established.

"Infiltrating Atmosphere", as used herein, means that atmosphere which is present which interacts with the matrix metal and/or preform (or filler material) and/or infiltration enhancer precursor and/or infiltration enhancer and permits or enhances spontaneous infiltration of the matrix metal to occur.

"Infiltration Enhancer", as used herein, means a material which promotes or assists in the spontaneous infiltration of a matrix metal into a filler material or preform. An infiltration enhancer may be formed from, for example, a reaction of an infiltration enhancer precursor with an infiltrating atmosphere to form (1) a gaseous species and/or (2) a reaction product of the infiltration enhancer precursor and the infiltrating atmosphere and/or (3) a reaction product of the infiltration enhancer precursor and the filler material or preform. Moreover, the infiltration enhancer may be supplied directly to at least one of the preform, and/or matrix metal, and/or infiltrating atmosphere and function in a substantially similar manner to an infiltration enhancer which has formed as a reaction between an infiltration enhancer precursor and another species. Ultimately, at least during the spontaneous infiltration, the infiltration enhancer should be located in at least a portion of the filler material or preform to achieve spontaneous infiltration.

"Infiltration Enhancer Precursor" or "Precursor to the Infiltration Enhancer", as used herein, means a material which when used in combination with the matrix metal, preform and/or infiltrating atmosphere forms an infiltration enhancer which induces or assists the matrix metal to spontaneously infiltrate the filler material or preform. Without wishing to be bound by any particular theory or explanation, it appears as though it may be necessary for the precursor to the infiltration enhancer to be capable of being positioned, located or transportable to a location which permits the infiltration enhancer precursor to interact with the infiltrating atmosphere and/or the preform or filler material and/or matrix metal. For example, in some matrix metal/infiltration enhancer precursor/infiltrating atmosphere systems, it is desirable for the infiltration enhancer precursor to volatilize at, near, or in some cases, even somewhat above the temperature at which the matrix metal becomes molten. Such volatilization may lead to: (1) a reaction of the infiltration enhancer precursor with the infiltrating atmosphere to form a gaseous species which enhances wetting of the filler material or preform by the matrix metal; and/or (2) a reaction of the infiltration enhancer precursor with the infiltrating atmosphere to form a solid, liquid or gaseous infiltration enhancer in at least a portion of the filler material or preform which enhances wetting; and/or (3) a reaction of the infiltration enhancer precursor within the filler material or preform which forms a solid, liquid or gaseous infiltration enhancer in at least a portion of the filler material or preform which enhances wetting.

"Matrix Metal" or "Matrix Metal Alloy", as used herein, means that metal which is utilized to form a metal matrix composite (e.g., before infiltration) and/or that metal which is intermingled with a filler material to form a metal matrix composite body (e.g., after infiltration). When a specified metal is mentioned as the matrix metal, it should be understood that such matrix metal includes that metal as an essentially pure metal, a commercially available metal having impurities and/or alloying constituents therein, an intermetallic compound or an alloy in which that metal is the major or predominant constituent.

"Matrix Metal/Infiltration Enhancer Precursor/Infiltrating Atmosphere System" or "Spontaneous System", as used herein, refers to that combination of materials which exhibit spontaneous infiltration into a preform or filler material. It should be understood that whenever a "/" appears between an exemplary matrix metal, infiltration enhancer precursor and infiltrating atmosphere that the "/" is used to designate a system or combination of materials which, when combined in a particular manner, exhibits spontaneous infiltration into a preform or filler material.

"Metal Matrix Composite" or "MMC", as used herein, means a material comprising a two- or three-dimensionally interconnected alloy or matrix metal which has embedded a preform or filler material. The matrix metal may include various alloying elements to provide specifically desired mechanical and physical properties in the resulting composite.

A Metal "Different" from the Matrix Metal means a metal which does not contain, as a primary constituent, the same metal as the matrix metal (e.g., if the primary constituent of the matrix metal is aluminum, the "different" metal could have a primary constituent of, for example, nickel).

"Nonreactive Vessel for Housing Matrix Metal" means any vessel which can house or contain a filler material (or preform) and/or molten matrix metal under the process conditions and not react with the matrix and/or the infiltrating atmosphere and/or infiltration enhancer precursor and/or a filler material or preform in a manner which would be significantly detrimental to the spontaneous infiltration mechanism. The nonreactive vessel may be disposable and removable after the spontaneous infiltration of the molten matrix metal has been completed.

"Preform" or "Permeable Preform", as used herein, means a porous mass of filler or filler material which is manufactured with at least one surface boundary which essentially defines a boundary for infiltrating matrix metal, such mass retaining sufficient shape integrity and green strength to provide dimensional fidelity prior to being infiltrated by the matrix metal. The mass should be sufficiently porous to accommodate spontaneous infiltration of the matrix metal thereinto. A preform typically comprises a bonded array or arrangement of filler, either homogeneous or heterogeneous, and may be comprised of any suitable material (e.g., ceramic and/or metal particulates, powders, fibers, whiskers, etc., and any combination thereof). A preform may exist either singularly or as an assemblage.

"Reaction System", as used herein, refers to that combination of materials which exhibit self-generated vacuum infiltration of a molten matrix metal into a filler material or preform. A reaction system comprises at least an impermeable container having therein a permeable mass of filler material or preform, a reactive atmosphere and a matrix metal.

"Reactive Atmosphere", as used herein, means an atmosphere which may react with the matrix metal and/or filler material (or preform) and/or impermeable container to form a self-generated vacuum, thereby causing molten matrix metal to infiltrate into the filler material (or preform) upon formation of the self-generated vacuum.

"Reservoir", as used herein, means a separate body of matrix metal positioned relative to a mass of filler or a preform so that, when the metal is molten, it may flow to replenish, or in some cases to initially provide and subsequently replenish, that portion, segment or source of matrix metal which is in contact with the filler or preform.

"Seal" or "Sealing Means", as used herein, refers to a gas-impermeable seal under the process conditions, whether formed independent of (e.g., an extrinsic seal) or formed by the reaction system (e.g., an intrinsic seal), which isolates the ambient atmosphere from the reactive atmosphere. The seal or sealing means may have a composition different from that of the matrix metal.

"Seal Facilitator", as used herein, is a material that facilitates formation of a seal upon reaction of the matrix metal with the ambient atmosphere and/or the impermeable container and/or the filler material or preform. The material may be added to the matrix metal, and the presence of the seal facilitator in the matrix metal may enhance the properties of the resultant composite body.

"Spontaneous Infiltration", as used herein, means the infiltration of matrix metal into the permeable mass of filler or preform occurs without requirement for the application of pressure or vacuum (whether externally applied or internally created).

"Wetting Enhancer", as used herein, refers to any material, which when added to the matrix metal and/or the filler material or preform, enhances the wetting (e.g., reduces surface tension of molten matrix metal) of the filler material or preform by the molten matrix metal. The presence of the wetting enhancer may also enhance the properties of the resultant metal matrix composite body by, for example, enhancing bonding between the matrix metal and the filler material.

BRIEF DESCRIPTION OF THE DRAWINGS

The following Figures are provided to assist in understanding the invention, but are not intended to limit the scope of the invention. Similar reference numerals have been used wherever possible in each of the Figures to denote like components, wherein.

DETAILED DESCRIPTION OF THE INVENTION AND PREFERRED EMBODIMENTS

The present invention relates generally to a metal matrix composite body for use as an armor material. Specifically, a metal matrix composite body which has a high volume percent filler loading (e.g., a filler loading of at least about 50 volume percent) can behave in a desirable manner as an armor material.

Any number of appropriate formation techniques can be used to form a metal matrix composite body having a high volume percent filler. However, two preferred techniques for forming such an armor material include the self-generated vacuum technique and the spontaneous infiltration technique discussed above-herein and later herein.

Figure 1:
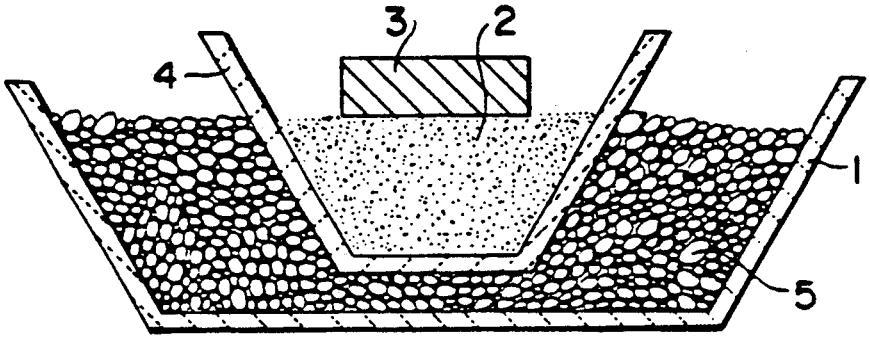
FIG. 1 is a schematic cross-sectional view of a lay-up for producing a spontaneously infiltrated metal matrix composite.

With reference to FIG. 1, a simple lay-up 10 for forming a spontaneously infiltrated metal matrix composite is illustrated. Specifically, a filler or preform 2, which may be of any suitable material, as discussed in detail below, is placed in a non-reactive vessel 4 for housing matrix metal and/or filler material. A matrix metal 3 is placed on or adjacent to the filler or preform 2. The lay-up is thereafter placed in a furnace to initiate spontaneous infiltration.

Without wishing to be bound by any particular theory or explanation, when an infiltration enhancer precursor is utilized in combination with at least one of the matrix metal, and/or filler material or preform and/or infiltrating atmosphere, the infiltration enhancer precursor may react to form an infiltration enhancer which induces or assists molten matrix metal to spontaneously infiltrate a filler material or preform. Moreover, it appears as though it may be necessary for the precursor to the infiltration enhancer to be capable of being positioned, located or transportable to a location which permits the infiltration enhancer precursor to interact with at least one of the infiltrating atmosphere, and/or the preform or filler material, and/or molten matrix metal. For example, in some matrix metal/infiltration enhancer precursor/infiltrating atmosphere systems, it is desirable for the infiltration enhancer precursor to volatilize at, near, or in some cases, even somewhat above the temperature at which the matrix metal becomes molten. Such volatilization may lead to: (1) a reaction of the infiltration enhancer precursor with the infiltrating atmosphere to form a gaseous species which enhances wetting of the filler material or preform by the matrix metal; and/or (2) a reaction of the infiltration enhancer precursor with the infiltrating atmosphere to form a solid, liquid or gaseous infiltration enhancer in at least a portion of the filler material or preform which enhances wetting; and/or (3) a reaction of the infiltration enhancer precursor within the filler material or preform which forms a solid, liquid or gaseous infiltration enhancer in at least a portion of the filler material or preform which enhances wetting.

Thus, for example, if an infiltration enhancer precursor was included or combined with, at least at some point during the process, molten matrix metal, it is possible that the infiltration enhancer could volatilize from the molten matrix metal and react with at least one of the filler material or preform and/or the infiltrating atmosphere. Such reaction could result in the formation of a solid species, if such solid species was stable at the infiltration temperature, said solid species being capable of being deposited on at least a portion of the filler material or preform as, for example, a coating. Moreover, it is conceivable that such solid species could be present as a discernable solid within at least a portion of the preform or filler material. If such a solid species was formed, molten matrix metal may have a tendency to react (e.g., the molten matrix metal may reduce the formed solid species) such that infiltration enhancer precursor may become associated with (e.g., dissolved in or alloyed with) the molten matrix metal. Accordingly, additional infiltration enhancer precursor may then be available to volatilize and react with another species (e.g., the filler material or preform and/or infiltrating atmosphere) and again form a similar solid species. It is conceivable that a continuous process of conversion of infiltration enhancer precursor to infiltration enhancer followed by a reduction reaction of the infiltration enhancer with molten matrix metal to again form additional infiltration enhancer, and so on, could occur, until the result achieved is a spontaneously infiltrated metal matrix composite.

In order to effect spontaneous infiltration of the matrix metal into the filler material or preform, an infiltration enhancer should be provided to the spontaneous system. An infiltration enhancer could be formed from an infiltration enhancer precursor which could be provided (1) in the matrix metal; and/or (2) in the filler material or preform; and/or (3) from the infiltrating atmosphere; and/or (4) from an external source into the spontaneous system. Moreover, rather than supplying an infiltration enhancer precursor, an infiltration enhancer may be supplied directly to at least one of the filler material or preform, and/or matrix metal, and/or infiltrating atmosphere. Ultimately, at least during the spontaneous infiltration, the infiltration enhancer should be located in at least a portion of the filler material or preform.

In a preferred embodiment of the invention, it is possible that the infiltration enhancer precursor can be at least partially reacted with the infiltrating atmosphere such that the infiltration enhancer can be formed in at least a portion of the filler material or preform prior to or substantially contiguous with contacting the filler material or preform with the matrix metal (e.g., if magnesium was the infiltration enhancer precursor and nitrogen was the infiltrating atmosphere, the infiltration enhancer could be magnesium nitride which would be located in at least a portion of the preform or filler material).

An example of a matrix metal/infiltration enhancer precursor/infiltrating atmosphere system is the aluminum/magnesium/nitrogen system. Specifically, an aluminum matrix metal can be contained within a suitable refractory vessel which, under the process conditions, does not adversely react with the aluminum matrix metal and/or the filler material when the aluminum is made molten. A filler material or preform can thereafter be contacted with molten aluminum matrix metal and spontaneously infiltrated.

Moreover, rather than supplying an infiltration enhancer precursor, an infiltration enhancer may be supplied directly to at least one of the preform or filler material, and/or matrix metal, and/or infiltrating atmosphere. Ultimately, at least during the spontaneous infiltration, the infiltration enhancer should be located in at least a portion of the filler material or preform.

Under the conditions employed in the method of the present invention, in the case of an aluminum/magnesium/nitrogen spontaneous infiltration system, the preform or filler material should be sufficiently permeable to permit the nitrogen-containing gas to penetrate or permeate the filler material or preform at some point during the process and/or contact the molten matrix metal. Moreover, the permeable filler material or preform can accommodate infiltration of the molten matrix metal, thereby causing the nitrogen-permeated preform to be infiltrated spontaneously with molten matrix metal to form a metal matrix composite body and/or cause the nitrogen to react with an infiltration enhancer precursor to form infiltration enhancer in the filler material or preform and thereby result in spontaneous infiltration. The extent of spontaneous infiltration and formation of the metal matrix composite will vary with a given set of process conditions, including magnesium content of the aluminum alloy, magnesium content of the preform or filler material, amount of magnesium nitride in the preform or filler material, the presence of additional alloying elements (e.g., silicon, iron, copper, manganese, chromium, zinc, and the like), average size of the filler material (e.g., particle diameter) comprising the preform or the filler material, surface condition and type of filler material or preform, nitrogen concentration of the infiltrating atmosphere, time permitted for infiltration and temperature at which infiltration occurs. For example, for infiltration of the molten aluminum matrix metal to occur spontaneously, the aluminum can be alloyed with at least about 1 percent by weight, and preferably at least about 3 percent by weight, magnesium (which functions as the infiltration enhancer precursor), based on alloy weight. Auxiliary alloying elements, as discussed above, may also be included in the matrix metal to tailor specific properties thereof. Additionally, the auxiliary alloying elements may affect the minimum amount of magnesium required in the matrix aluminum metal to result in spontaneous infiltration of the filler material or preform. Loss of magnesium from the spontaneous system due to, for example, volatilization should not occur to such an extent that no magnesium was present to form infiltration enhancer. Thus, it is desirable to utilize a sufficient amount of initial alloying elements to assure that spontaneous infiltration will not be adversely affected by volatilization. Still further, the presence of magnesium in both of the preform (or filler material) and matrix metal or the preform (or filler material) alone may result in a reduction in required amount of magnesium to achieve spontaneous infiltration (discussed in greater detail later herein).

The volume percent of nitrogen in the infiltrating atmosphere also affects formation rates of the metal matrix composite body. Specifically, if less than about 10 volume percent of nitrogen is present in the atmosphere, very slow or little spontaneous infiltration will occur. It has been discovered that it is preferable for at least about 50 volume percent of nitrogen to be present in the atmosphere, thereby resulting in, for example, shorter infiltration times due to a much more rapid rate of infiltration. The infiltrating atmosphere (e.g., a nitrogen-containing gas) can be supplied directly to the filler material or preform and/or matrix metal, or it may be produced or result from a decomposition of a material.

The minimum magnesium content required for the molten matrix metal to infiltrate a filler material or preform depends on one or more variables such as the processing temperature, time, the presence of auxiliary alloying elements such as silicon or zinc, the nature of the filler material, the location of the magnesium in one or more components of the spontaneous system, the nitrogen content of the atmosphere, and the rate at which the nitrogen atmosphere flows. Lower temperatures or shorter heating times can be used to obtain complete infiltration as the magnesium content of the alloy and/or preform is increased. Also, for a given magnesium content, the addition of certain auxiliary alloying elements such as zinc permits the use of lower temperatures. For example, a magnesium content of the matrix metal at the lower end of the operable range, e.g., from about 1 to 3 weight percent, may be used in conjunction with at least one of the following: an above-minimum processing temperature, a high nitrogen concentration, or one or more auxiliary alloying elements. When no magnesium is added to the preform, alloys containing from about 3 to 5 weight percent magnesium are preferred on the basis of their general utility over a wide variety of process conditions, with at least about 5 percent being preferred when lower temperatures and shorter times are employed. Magnesium contents in excess of about 10 percent by weight of the aluminum alloy may be employed to moderate the temperature conditions required for infiltration. The magnesium content may be reduced when used in conjunction with an auxiliary alloying element, but these elements serve an auxiliary function only and are used together with at least the above-specified minimum amount of magnesium. For example, there was substantially no infiltration of nominally pure aluminum alloyed only with 10 percent silicon at 1000° C. into a bedding of 500 mesh, 39 Crystolon (99 percent pure silicon carbide from Norton Co.). However, in the presence of magnesium, silicon has been found to promote the infiltration process. As a further example, the amount of magnesium varies if it is supplied exclusively to the preform or filler material. It has been discovered that spontaneous infiltration will occur with a lesser weight percent of magnesium supplied to the spontaneous system when at least some of the total amount of magnesium supplied is placed in the preform or filler material. It may be desirable for a lesser amount of magnesium to be provided in order to prevent the formation of undesirable intermetallics in the metal matrix composite body. In the case of a silicon carbide preform, it has been discovered that when the preform is contacted with an aluminum matrix metal, the preform containing at least about 1% by weight magnesium and being in the presence of a substantially pure nitrogen atmosphere, the matrix metal spontaneously infiltrates the preform. In the case of an alumina preform, the amount of magnesium required to achieve acceptable spontaneous infiltration is slightly higher. Specifically, it has been found that when an alumina preform, when contacted with a similar aluminum matrix metal, at about the same temperature as the aluminum that infiltrated into the silicon carbide preform, and in the presence of the same nitrogen atmosphere, at least about 3% by weight magnesium may be required to achieve similar spontaneous infiltration to that achieved in the silicon carbide preform discussed immediately above.

It is also noted that it is possible to supply to the spontaneous system infiltration enhancer precursor and/or infiltration enhancer on a surface of the alloy and/or on a surface of the preform or filler material and/or within the preform or filler material prior to infiltrating the matrix metal into the filler material or preform (i.e., it may not be necessary for the supplied infiltration enhancer or infiltration enhancer precursor to be alloyed with the matrix metal, but rather, simply supplied to the spontaneous system). For example, in the aluminum/magnesium/nitrogen system, if the magnesium was applied to a surface of the matrix metal it may be preferred that the surface should be the surface which is closest to, or preferably in contact with, the permeable mass of filler material or vice versa; or such magnesium could be mixed into at least a portion of the preform or filler material. Still further, it is possible that some combination of surface application, alloying and placement of magnesium into at least a portion of the preform could be used. Such combination of applying infiltration enhancer(s) and/or infiltration enhancer precursor(s) could result in a decrease in the total weight percent of magnesium needed to promote infiltration of the matrix aluminum metal into the preform, as well as achieving lower temperatures at which infiltration can occur. Moreover, the amount of undesirable intermetallics formed due to the presence of magnesium could also be minimized.

The use of one or more auxiliary alloying elements and the concentration of nitrogen in the surrounding gas also affects the extent of nitriding of the matrix metal at a given temperature. For example, auxiliary alloying elements such as zinc or iron included in the alloy, or placed on a surface of the alloy, may be used to reduce the infiltration temperature and thereby decrease the amount of nitride formation, whereas increasing the concentration of nitrogen in the gas may be used to promote nitride formation.

The concentration of magnesium in the alloy, and/or placed onto a surface of the alloy, and/or combined in the filler or preform material, also tends to affect the extent of infiltration at a given temperature. Consequently, in some cases where little or no magnesium is contacted directly with the preform or filler material, it may be preferred that at least about three weight percent magnesium be included in the alloy. Alloy contents of less than this amount, such as one weight percent magnesium, may require higher process temperatures or an auxiliary alloying element for infiltration. The temperature required to effect the spontaneous infiltration process of this invention may be lower: (1) when the magnesium content of the alloy alone is increased, e.g., to at least about 5 weight percent; and/or (2) when alloying constituents are mixed with the permeable mass of filler material or preform; and/or (3) when another element such as zinc or iron is present in the aluminum alloy. The temperature also may vary with different filler materials. In general, in the aluminum/magnesium/nitrogen system spontaneous and progressive infiltration will occur at a process temperature of at least about 675° C., and preferably a process temperature of at least about 750° C. 800° C. Temperatures generally in excess of 1200° C. do not appear to benefit the process, and a particularly useful temperature range has been found to be from about 675° C. to about 1000° C. However, as a general rule, the spontaneous infiltration temperature is a temperature which is above the melting point of the matrix metal but below the volatilization temperature of the matrix metal. Moreover, the spontaneous infiltration temperature should be below the melting point of the filler material. Still further, as temperature is increased, the tendency to form a reaction product between the matrix metal and infiltrating atmosphere increases (e.g., in the case of aluminum matrix metal and a nitrogen infiltrating atmosphere, aluminum nitride may be formed). Such reaction product may be desirable or undesirable based upon the intended application of the metal matrix composite body. Additionally, electric resistance heating is typically used to achieve the infiltrating temperatures. However, any heating means which can cause the matrix metal to become molten and does not adversely affect spontaneous infiltration, is acceptable for use with the invention.

In the present method, for example, a permeable filler material or preform comes into contact with molten aluminum in the presence of, at least sometime during the process, a nitrogen-containing gas. The nitrogen-containing gas may be supplied by maintaining a continuous flow of gas into contact with at least one of the filler material or preform and/or molten aluminum matrix metal. Although the flow rate of the nitrogen-containing gas is not critical, it is preferred that the flow rate be sufficient to compensate for any nitrogen lost from the atmosphere due to any nitride formation, and also to prevent or inhibit the incursion of air which can have an oxidizing effect on the molten metal.

The method of forming a metal matrix composite is applicable to a wide variety of filler materials, and the choice of filler materials will depend on such factors as the matrix alloy, the process conditions, the reactivity of the molten matrix alloy with the filler material, and the properties sought for the final composite product. For example, when aluminum is the matrix metal, suitable filler materials include (a) oxides, e.g. alumina, magnesia, zirconia; (b) carbides, e.g. silicon carbide; (c) borides, e.g. aluminum dodecaboride, titanium diboride; (d) nitrides, e.g. aluminum nitride; and (e) mixtures thereof. If there is a tendency for the filler material to react with the molten aluminum matrix metal, this might be accommodated by minimizing the infiltration time and temperature or by providing a non-reactive coating on the filler. The filler material may comprise a substrate, such as carbon or other nonceramic material, bearing a ceramic coating to protect the substrate from attack or degradation. Suitable ceramic coatings include oxides, carbides, borides and nitrides. Ceramics which are preferred for use in the present method include alumina and silicon carbide in the form of particles, platelets, whiskers and fibers. The fibers can be discontinuous (in chopped form) or in the form of continuous filament, such as multifilament tows. Further, the filler material or preform may be homogeneous or heterogeneous.

It also has been discovered that certain filler materials exhibit enhanced infiltration relative to filler materials having a similar chemical composition. For example, crushed alumina bodies made by the method disclosed in U.S. Pat. No. 4,713,360, entitled "Novel Ceramic Materials and Methods of Making Same", which issued on Dec. 15, 1987, in the names of Marc S. Newkirk et al., exhibit desirable infiltration properties relative to commercially available alumina products. Moreover, crushed alumina bodies made by the method disclosed in Commonly Owned Application Ser. No. 819,397, entitled "Composite Ceramic Articles and Methods of Making Same", in the names of Marc S. Newkirk et al., also exhibit desirable infiltration properties relative to commercially available alumina products. The subject matter of each of the issued Patent Application is herein expressly incorporated by reference. Thus, it has been discovered that complete infiltration of a permeable mass of ceramic material can occur at lower infiltration temperatures and/or lower infiltration times by utilizing a crushed or comminuted body produced by the method of the aforementioned U.S. Patent and Patent Application.

The size, shape, chemistry and volume percent of the filler material (or preform) can be any that may be required to achieve the properties desired in the composite. Thus, the filler material may be in the form of particles, whiskers, platelets or fibers since infiltration is not restricted by the shape of the filler material. Other shapes such as spheres, tubules, pellets, refractory fiber cloth, and the like may be employed. In addition, the size of the filler material does not limit infiltration, although a higher temperature or longer time period may be needed for complete infiltration of a mass of smaller particles than for larger particles or vice-versa depending on the particular reaction conditions. Average particle diameters as small as a micron or less to about 1100 microns or more can be successfully utilized in the present invention, with a range of about 2 microns through about 1000 microns being preferred for a vast majority of commercial applications. Further, the mass of filler material (or preform) to be infiltrated should be permeable (i.e., contain at least some interconnected porosity to render it permeable to molten matrix metal and/or to the infiltrating atmosphere). Moreover, by controlling the size (e.g., particle diameter) and/or geometry and/or composition of the filler material or the material comprising the preform, the physical and mechanical properties of the formed metal matrix composite can be controlled or engineered to meet any number of industrial needs. For example, wear resistance of the metal matrix composite can be increased by increasing the size of the filler material (e.g., increasing the average diameter of the filler material particles) given that the filler material has a higher wear resistance than the matrix metal. However, strength and/or toughness may tend to increase with decreasing filler size. Further, the thermal expansion coefficient of the metal matrix composite may decrease with increasing filler loading, given that the coefficient of thermal expansion of the filler is lower than the coefficient of thermal expansion of the matrix metal. Still further, the mechanical and/or physical properties (e.g., density, coefficient of thermal expansion, elastic and/or specific modulus, strength and/or specific strength, etc.) of a formed metal matrix composite body may be tailored depending on the loading of the filler material in the loose mass or in the preform. For example, by providing a loose mass or preform comprising a mixture of filler particles of varying sizes and/or shapes, wherein the density of the filler is greater than that of the matrix metal, a higher filler loading, due to enhanced packing of the filler materials, may be achieved, thereby resulting in a metal matrix composite body with an increased density. By utilizing the teachings of the present invention, the volume percent of filler material or preform which can be infiltrated can vary over a wide range. The lower volume percent of filler that can be infiltrated is limited primarily by the ability to form a porous filler material or preform, (e.g., about 10 volume percent); whereas the higher volume percent of filler or preform that can be infiltrated is limited primarily by the ability to form a dense filler material or preform with at least some interconnected porosity (e.g., about 95 volume percent). Accordingly, by practicing any of the above teachings, alone or in combination, a metal matrix composite can be engineered to contain a desired combination of properties.

The method of forming metal matrix composites according to the present invention, not being dependent on the use of pressure to force or squeeze molten matrix metal into a preform or a mass of filler material, permits the production of substantially uniform metal matrix composites having a high volume fraction of filler material and low porosity. Higher volume fractions of filler material may be achieved by using a lower porosity initial mass of filler material. Higher volume fractions also may be achieved if the mass of filler is compacted or otherwise densified provided that the mass is not converted into either a compact with closed cell porosity or into a fully dense structure that would prevent infiltration by the molten alloy. Specifically, volume fractions on the order of about 60 to 80 volume percent can be achieved by methods such as vibrational packing, controlling particle size distribution, etc. However, alternative techniques can be utilized to achieve even higher volume fractions of filler. Volume fractions of filler on the order of 40 to 50 percent are preferred for thermo-forming in a preferred embodiment of the present invention. At such volume fractions, the infiltrated composite maintains or substantially maintains its shape, thereby facilitating secondary processing. Higher or lower particle loadings or volume fractions could be used, however, depending on the desired final composite loading after thermo-forming. Moreover, methods for reducing particle loadings can be employed in connection with the thermo-forming processes of the present invention to achieve lower particle loadings.

It has been observed that for aluminum infiltration and matrix formation around a ceramic filler, wetting of the ceramic filler by the aluminum matrix metal may be an important part of the infiltration mechanism. Further, the wetting of the filler by molten matrix metal may permit a uniform dispersion of the filler throughout the formed metal matrix composite and improve the bonding of the filler to the matrix metal. Moreover, at low processing temperatures, a negligible or minimal amount of metal nitriding occurs resulting in a minimal discontinuous phase of aluminum nitride dispersed in the metal matrix. However, as the upper end of the temperature range is approached, nitridation of the metal is more likely to occur. Thus, the amount of the nitride phase in the metal matrix can be controlled by varying the processing temperature at which infiltration occurs. The specific process temperature at which nitride formation becomes more pronounced also varies with such factors as the matrix aluminum alloy used and its quantity relative to the volume of filler or preform, the filler material to be infiltrated, and the nitrogen concentration of the infiltrating atmosphere. For example, the extent of aluminum nitride formation at a given process temperature is believed to increase as the ability of the alloy to wet the filler decreases and as the nitrogen concentration of the atmosphere increases.

It is therefore possible to tailor the constituency of the metal matrix during formation of the composite to impart certain characteristics to the resulting product. For a given system, the process conditions can be selected to control the nitride formation. A composite product containing an aluminum nitride phase will exhibit certain properties which can be favorable to, or improve the performance of, the product. Further, the temperature range for spontaneous infiltration with an aluminum alloy may vary with the ceramic material used. In the case of alumina as the filler material, the temperature for infiltration should preferably not exceed about 1000° C. if it is desired that the ductility of the matrix not be reduced by the significant formation of nitride. However, temperatures exceeding 1000° C. may be employed if it is desired to produce a composite with a less ductile and stiffer matrix. To infiltrate silicon carbide, higher temperatures of about 1200° C. may be employed since the aluminum alloy nitrides to a lesser extent, relative to the use of alumina as filler, when silicon carbide is employed as a filler material.

Further, the constituency of the matrix metal within the metal matrix composite and defects, for example, porosity, may be modified by controlling the cooling rate of the metal matrix composite. For example, the metal matrix composite may be directionally solidified by any number of techniques including: placing the container holding the metal matrix composite upon a chill plate; and/or selectively placing insulating materials about the container. Further, the constituency of the metal matrix may be modified after formation of the metal matrix composite. For example, exposure of the formed metal matrix composite to a heat treatment may improve the tensile strength of the metal matrix composite. (The standard test for tensile strength is ASTM-D3552-77 (reapproved 1982).)

For example, a desirable heat treatment for a metal matrix composite containing a 520.0 aluminum alloy as the matrix metal may comprise heating the metal matrix composite to an elevated temperature, for example, to about 430° C., which is maintained for an extended period (e.g., 18–20 hours). The metal matrix may then be quenched in boiling water at about 100° C. for about 20 seconds (i.e., a T-4 heat treatment) which can temper or improve the ability of the composite to withstand tensile stresses.

Moreover, it is possible to use a reservoir of matrix metal to assure complete infiltration of the filler material and/or to supply a second metal which has a different composition from the first source of matrix metal. Specifically, in some cases it may be desirable to utilize a matrix metal in the reservoir which differs in composition from the first source of matrix metal. For example, if an aluminum alloy is used as the first source of matrix metal, then virtually any other metal or metal alloy which was molten at the processing temperature could be used as the reservoir metal. Molten metals frequently are very miscible with each other which would result in the reservoir metal mixing with the first source of matrix metal so long as an adequate amount of time is given for the mixing to occur. Thus, by using a reservoir metal which is different in composition from the first source of matrix metal, it is possible to tailor the properties of the metal matrix to meet various operating requirements and thus tailor the properties of the metal matrix composite.

A barrier means may also be utilized in combination with the present invention. Specifically, the barrier means for use with this invention may be any suitable means which interferes, inhibits, prevents or terminates the migration, movement, or the like, of molten matrix alloy (e.g., an aluminum alloy) beyond the defined surface boundary of the filler material. Suitable barrier means may be any material, compound, element, composition, or the like, which, under the process conditions of this invention, maintains some integrity, is not volatile and preferably is permeable to the gas used with the process, as well as being capable of locally inhibiting, stopping, interfering with, preventing, or the like, continued infiltration or any other kind of movement beyond the defined surface boundary of the ceramic filler. Barrier means may be used during spontaneous infiltration or in any molds or other fixtures utilized in connection with thermo-forming of the spontaneously infiltrated metal matrix composite, as discussed in greater detail below.

Suitable barrier means includes materials which are substantially non-wettable by the migrating molten matrix alloy under the process conditions employed. A barrier of this type appears to exhibit little or no affinity for the molten matrix alloy, and movement beyond the defined surface boundary of the filler material or preform is prevented or inhibited by the barrier means. The barrier reduces any final machining or grinding that may be required of the metal matrix composite product. As stated above, the barrier preferably should be permeable or porous, or rendered permeable by puncturing, to permit the gas to contact the molten matrix alloy.

Suitable barriers particularly useful for aluminum matrix alloys are those containing carbon, especially the crystalline allotropic form of carbon known as graphite. Graphite is essentially non-wettable by the molten aluminum alloy under the described process conditions. A particular preferred graphite is a graphite foil product that is sold under the trademark GRAFOIL ®, registered to Union Carbide. This graphite foil exhibits sealing characteristics that prevent the migration of molten aluminum alloy beyond the defined surface boundary of the filler material. This graphite foil is also resistant to heat and is chemically inert. GRAFOIL ® graphite foil is flexible, compatible, conformable and resilient. It can be made into a variety of shapes to fit any barrier application. However, graphite barrier means may be employed as a slurry or paste or even as a paint film around and on the boundary of the filler material or preform. GRAFOIL ® is particularly preferred because it is in the form of a flexible graphite sheet. In use, this paper-like graphite is simply formed around the filler material or preform.

Other preferred barrier(s) for aluminum metal matrix alloys in nitrogen are the transition metal borides (e.g., titanium diboride ($TiB_2$)) which are generally non-wettable by the molten aluminum metal alloy under certain of the process conditions employed using this material. With a barrier of this type, the process temperature should not exceed about 875° C., for otherwise the barrier material becomes less efficacious and, in fact, with increased temperature infiltration into the barrier will occur. Moreover, the particle size of the barrier material may affect the ability of the material to inhibit spontaneous infiltration. The transition metal borides are typically in a particulate form (1–30 microns). The barrier materials may be applied as a slurry or paste to the boundaries of the permeable mass of ceramic filler material which preferably is preshaped as a preform.

Other useful barriers for aluminum metal matrix alloys in nitrogen include low-volatile organic compounds applied as a film or layer onto the external surface of the filler material or preform. Upon firing in nitrogen, especially at the process conditions of this invention, the organic compound decomposes leaving a carbon soot film. The organic compound may be applied by conventional means such as painting, spraying, dipping, etc.

Moreover, finely ground particulate materials can function as a barrier so long as infiltration of the particulate material would occur at a rate which is slower than the rate of infiltration of the filler material.

Thus, the barrier means may be applied by any suitable means, such as by covering the defined surface boundary with a layer of the barrier means. Such a layer of barrier means may be applied by painting, dipping, silk screening, evaporating, or otherwise applying the barrier means in liquid, slurry, or paste form, or by sputtering a vaporizable barrier means, or by simply depositing a layer of a solid particulate barrier means, or by applying a solid thin sheet or film of barrier means onto the defined surface boundary. With the barrier means in place, spontaneous infiltration substantially terminates when the infiltrating matrix metal reaches the defined surface boundary and contacts the barrier means.

Figure 2:
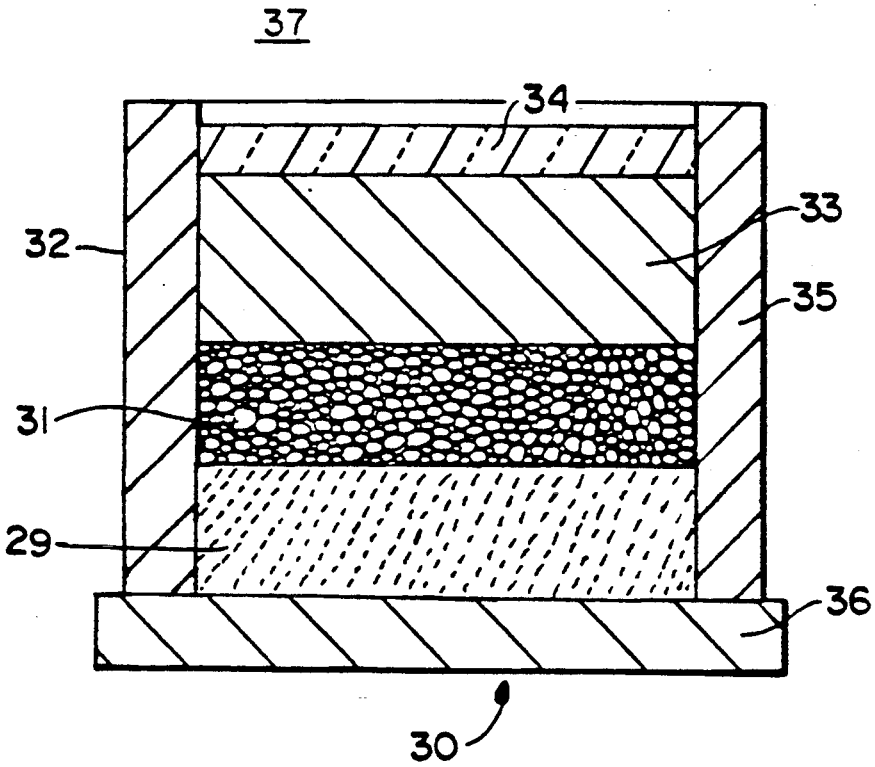
FIG. 2 is a schematic cross-sectional view of a typical lay-up for producing a metal matrix composite by the self-generated vacuum technique.

With reference to FIG. 2, a typical lay-up 30 for forming a metal matrix composite by a self-generated vacuum technique according to the present invention is illustrated. Specifically, a filler material or preform 31, which may be of any suitable material as discussed in more detail below, is disposed in an impermeable container 32 which is capable of housing a molten matrix metal 33 and a reactive atmosphere. For example, the filler material 31 may be contacted with a reactive atmosphere (e.g., that atmosphere which exists within the porosity of the filler material or preform) for a time sufficient to allow the reactive atmosphere to permeate either partially or substantially completely the filler material 31 in the impermeable container 32. The matrix metal 33, in either a molten form or a solid ingot form, is then placed in contact with the filler material 31. As described in more detail below in a preferred embodiment, an extrinsic seal or sealing means 34 may be provided, for example, on the surface of the matrix metal 33, to isolate the reactive atmosphere from the ambient atmosphere 37. The sealing means, whether extrinsic or intrinsic, may or may not function as a sealing means at room temperature, but should function as a sealing means under the process conditions (e.g., at or above the melting point of the matrix metal). The lay-up 30 is subsequently placed into a furnace, which is either at room temperature or has been preheated to about the process temperature. Under the process conditions, the furnace operates at a temperature above the melting point of the matrix metal to permit infiltration of molten matrix metal into the filler material or preform by the formation of a self-generated vacuum.

Figure 3:
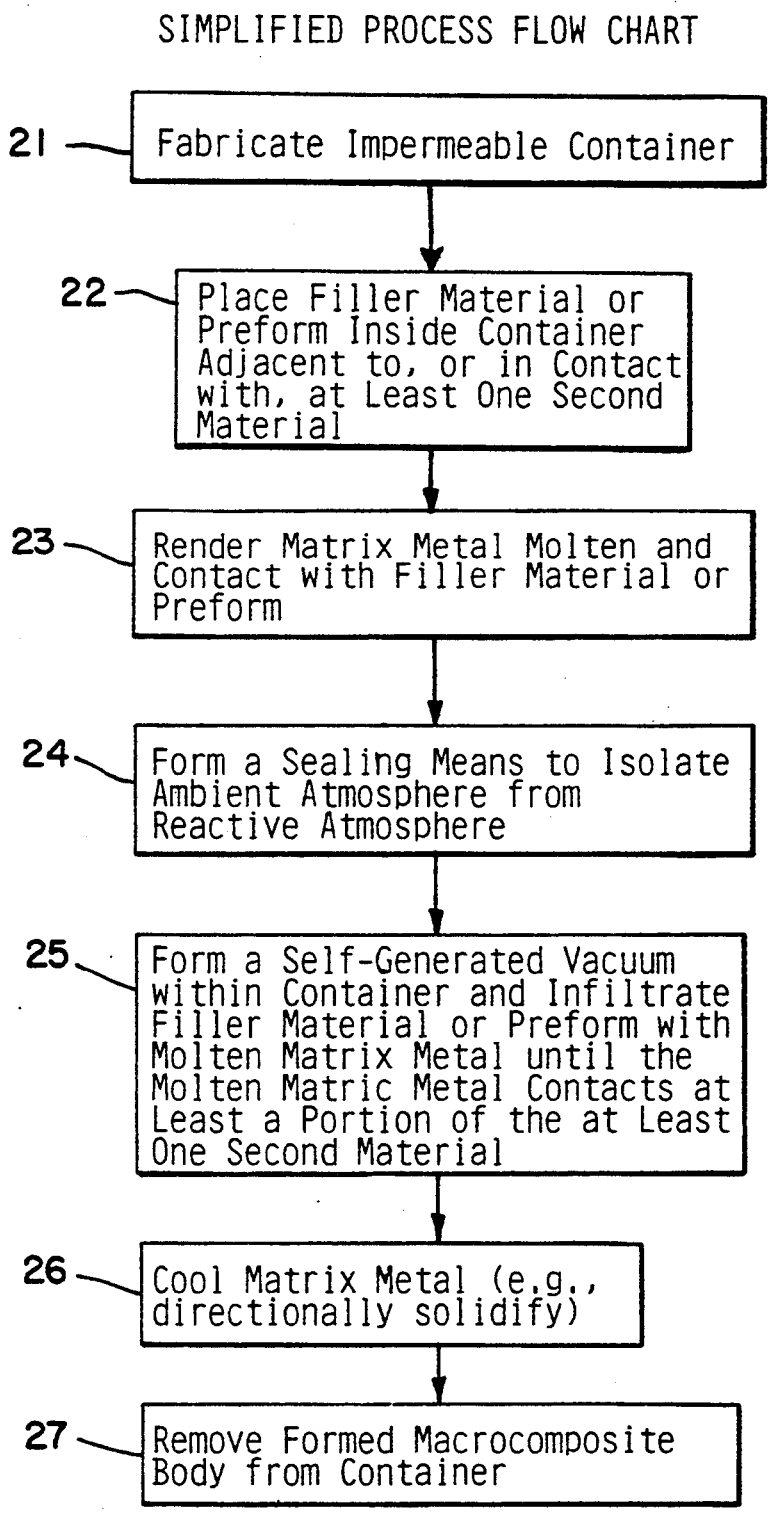
FIG. 3 is a simplified flowchart of the self-generated vacuum method as applied to a standard lay-up.

Referring to FIG. 3, there is shown a simplified flowchart of process steps for carrying out the method of the present invention. In step (21), a suitable impermeable container can be fabricated or otherwise obtained that has the appropriate properties described in more detail below. For example, a simple open-topped steel (e.g., stainless steel) cylinder is suitable as a mold. The steel container may then optionally be lined with GRAFOIL ® graphite tape (GRAFOIL ® is a registered trademark of Union Carbide) to facilitate removal of the metal matrix composite body which is to be formed in the container. As described in more detail below, other materials, such as $B_2O_3$ dusted inside the container, or tin which is added to the matrix metal, can also be used to facilitate release of the metal matrix composite body from the container or mold. The container can then be loaded with a desired quantity of a suitable filler material or preform which, optionally, can be at least partially covered with another layer of GRAFOIL ® tape. That layer of graphite tape facilitates separation of the metal matrix composite body from any carcass of matrix metal remaining after infiltration of the filler material.

A quantity of molten matrix metal, e.g., aluminum, bronze, copper, cast iron, magnesium, etc., can then be poured into the container. The container could be at room temperature or it could be preheated to any suitable temperature. Moreover, matrix metal could initially be provided as solid ingots of matrix metal and thereafter heated to render the ingots molten. An appropriate sealing means (described below in greater detail) selected from the group consisting of an extrinsic sealing means and an intrinsic sealing means can then be formed. For example, if it was desired to form an extrinsic seal, an extrinsic sealing means, such as a glass (e.g., $B_2O_3$) frit, can be applied to the surface of the pool of molten matrix metal in the container. The frit then melts, typically covering the surface of the pool, but, as described in more detail below, full coverage is not required. After contacting molten matrix metal with a filler material or preform and sealing the matrix metal and/or filler material from the ambient atmosphere by an extrinsic sealing means, if needed, the container is set in a suitable furnace, which may be preheated to the processing temperature, for a suitable amount of time to permit infiltration to occur. The processing temperature of the furnace may be different for different matrix metals (for example, about 950° C. for some aluminum alloys and about 1100° C. for some bronze alloys are desirable). The appropriate processing temperature will vary depending on the melting point and other characteristics of the matrix metal, as well as specific characteristics of components in the reaction system and the sealing means. After a suitable amount of time at temperature in the furnace, a vacuum will be created (described below in greater detail) within the filler material or preform, thereby permitting molten matrix metal to infiltrate the filler material or preform. The container can then be removed from the furnace and cooled, for example, by placing it on a chill plate to directionally solidify the matrix metal. The metal matrix composite can then be removed in any convenient manner from the container and separated from the carcass of matrix metal, if any.

It will be appreciated that the foregoing descriptions of FIGS. 2 and 3 are simply to highlight salient features of the present invention. Further details of the steps in the process and of the characteristics of the materials which can be used in the process are set forth below.

Without wishing to be bound by any particular theory or explanation, it is believed that when a suitable matrix metal, typically in a molten state, contacts a suitable filler material or preform in the presence of a suitable reactive atmosphere in an impermeable container, a reaction may occur between the reactive atmosphere and the molten matrix metal and/or filler material or preform and/or impermeable container that results in a reaction product (e.g., a solid, liquid or vapor) which occupies a lesser volume than the initial volume occupied by the reaction components. When the reactive atmosphere is isolated from the ambient atmosphere, a vacuum may be created in the permeable filler material or preform which draws molten matrix metal into the void spaces of the filler material. Continued reaction between the reactive atmosphere and the molten matrix metal and/or filler material or preform and/or impermeable container may result in the matrix metal infiltrating the filler material or preform as additional vacuum is generated. The reaction may be continued for a time sufficient to permit molten matrix metal to infiltrate, either partially or substantially completely, the mass of filler material or preform. The filler material or preform should be sufficiently permeable to allow the reactive atmosphere to permeate, at least partially, the mass of filler material or preform.

This application discusses various matrix metals which at some point during the formation of a metal matrix composite are contacted with a reactive atmosphere. Thus various references will be made to particular matrix metal/reactive atmosphere combinations or systems which exhibit self-generated vacuum formation. Specifically, self-generated vacuum behavior has been observed in the aluminum/air system; the aluminum/oxygen system; the aluminum/nitrogen system; the bronze/air system; the bronze/nitrogen system; the copper/air system; the copper/nitrogen system and the cast iron/air system. However, it will be understood that matrix metal/reactive atmosphere systems other than those specifically discussed in this application may behave in a similar manner.

In order to practice the self-generated vacuum technique of the present invention, it is necessary for the reactive atmosphere to be physically isolated from the ambient atmosphere such that the reduced pressure of the reactive atmosphere which exists during infiltration will not be significantly adversely affected by any gas being transported from the ambient atmosphere. An impermeable container that can be utilized in the method of the present invention may be a container of any size, shape and/or composition which may or may not be nonreactive with the matrix metal and/or reactive atmosphere and that is impermeable to the ambient atmosphere under the process conditions. Specifically, the impermeable container may comprise any material (e.g., ceramic, metal, glass, polymer, etc.) which can survive the process conditions such that it maintains its size and shape and which prevents or sufficiently inhibits transport of the ambient atmosphere through the container. By utilizing a container which is sufficiently impermeable to transport of atmosphere through the container, it is possible to form a self-generated vacuum within the container. Further, depending on the particular reaction system used, an impermeable container which is at least partially reactive with the reactive atmosphere and/or matrix metal and/or filler material may be used to create or assist in creating a self-generated vacuum within the container.

The characteristics of a suitable impermeable container are freedom from pores, cracks or reducible oxides, each of which may adversely interfere with the development or maintenance of a self-generated vacuum. It will thus be appreciated that a wide variety of materials can be used to form impermeable containers. For example, molded or cast alumina or silicon carbide can be used, as well as metals having limited or low solubility in the matrix metal, e.g., stainless steel for aluminum, copper and bronze matrix metals.

In addition, otherwise unsuitable materials such as porous materials (e.g., ceramic bodies) can be rendered impermeable by formation of a suitable coating on at least a portion thereof. Such impermeable coatings may be any of a wide variety of glazes and gels suitable for bonding to and sealing such porous materials. Furthermore, a suitable impermeable coating may be liquid at process temperatures, in which case the coating material should be sufficiently stable to remain impermeable under the self-generated vacuum, for example, by viscously adhering to the container or the filler material or preform. Suitable coating materials include glassy materials (e.g., $B_2O_3$) chlorides, carbonates, etc., provided that the pore-size of the filler or preform is small enough that the coating can effectively block the pores to form an impermeable coating.

The matrix metal used in the method of the present invention may be any matrix metal which, when molten under the process conditions, infiltrates the filler material or preform upon the creation of a vacuum within the filler material. For example, the matrix metal may be any metal, or constituent within the metal, which reacts with the reactive atmosphere under the process conditions, either partially or substantially completely, thereby causing the molten matrix metal to infiltrate the filler material or preform due to, at least in part, the creation of a vacuum therein. Further, depending on the system utilized, the matrix metal may be either partially Or substantially non-reactive with the reactive atmosphere, and a vacuum may be created due to a reaction of the reactive atmosphere with, optionally, one or more other components of the reaction system, thereby permitting the matrix metal to infiltrate the filler material.

In a preferred embodiment, the matrix metal may be alloyed with a wetting enhancer to facilitate the wetting capability of the matrix metal, thus, for example, facilitating the formation of a bond between the matrix metal and the filler, reducing porosity in the formed metal matrix composite, reducing the amount of time necessary for complete infiltration, etc. Moreover, a material which comprises a wetting enhancer may also act as a seal facilitator, as described below, to assist in isolating the reactive atmosphere from the ambient atmosphere. Still further, in another preferred embodiment, a wetting enhancer may be incorporated directly into the filler material rather than being alloyed with the matrix metal.

Thus, wetting of the filler material by the matrix metal may enhance the properties (e.g., tensile strength, erosion resistance, etc.) of the resultant composite body. Further, wetting of the filler material by molten matrix metal may permit a uniform dispersion of filler throughout the formed metal matrix composite and improve bonding of the filler to the matrix metal. Useful wetting enhancers for an aluminum matrix metal include magnesium, bismuth, lead, tin, etc., and for bronze and copper matrix metals include selenium, tellurium, sulfur, etc. Moreover, as discussed above, at least one wetting enhancer may be added to the matrix metal and/or filler material to impart desired properties to the resultant metal matrix composite body.

Moreover, it is possible to use a reservoir of matrix metal to ensure complete infiltration of matrix metal into the filler material and/or to supply a second metal which has a different composition from the first source of matrix metal. Specifically, in some cases it may be desirable to utilize a matrix metal in the reservoir which differs in composition from the first source of matrix metal. For example, if an aluminum alloy is used as the first source of matrix metal, then virtually any other metal or metal alloy which is molten at the processing temperature could be used as the reservoir metal. Molten metals frequently are very miscible with each other which would result in the reservoir metal mixing with the first source of matrix metal, so long as an adequate amount of time is given for the mixing to occur. Thus, by using a reservoir metal which is different in composition from the first source of matrix metal, it is possible to tailor the properties of the matrix metal to meet various operating requirements and thus tailor the properties of the metal matrix composite body.

The temperature to which the reaction system is exposed (e.g., processing temperature) may vary depending upon which matrix metals, filler materials or preforms, and reactive atmospheres are used. For example, for an aluminum matrix metal, the present self-generated vacuum process generally proceeds at a temperature of at least about 700° C. and preferably about 850° C. or more. Temperatures in excess of 1000° C. are generally not necessary, and a particularly useful range is 850° C. to 1000° C. For a bronze or copper matrix metal, temperatures of about 1050° C. to about 1125° C. are useful, and for cast iron, temperatures of about 1250° C. to about 1400° C. are suitable. Generally, temperatures which are above the melting point but below the volatilization point of the matrix metal may be used.

It is possible to tailor the composition and/or microstructure of the metal matrix during formation of the composite to impart desired characteristics to the resulting product. For example, for a given system, the process conditions may be selected to control the formation of, e.g., intermetallics, oxides, nitrides, etc. Further, in addition to tailoring the composition of the composite body, other physical characteristics, e.g., porosity, may be modified by controlling the cooling rate of the metal matrix composite body. In some cases, it may be desirable for the metal matrix composite to be directionally solidified by placing, for example, the container holding the formed metal matrix composite onto a chill plate and/or selectively placing insulating materials about the container. Further, additional properties (e.g., tensile strength) of the formed metal matrix composite may be controlled by using a heat treatment (e.g., a standard heat treatment which corresponds substantially to a heat treatment for the matrix metal alone, or one which has been modified partially or significantly).

Under the conditions employed in the method of the present invention, the mass of filler material or preform should be sufficiently permeable to allow the reactive atmosphere to penetrate or permeate the filler material or preform at some point during the process prior to isolation of the ambient atmosphere from the reactive atmosphere. In the Examples utilizing a self-generated vacuum technique which are set forth below, a sufficient amount of reactive atmosphere was contained within loosely packed particles having particle sizes ranging from about 54 to about 220 grit. By providing such a filler material, the reactive atmosphere may, either partially or substantially completely, react upon contact with the molten matrix metal and/or filler material and/or impermeable container, thereby resulting in the creation of a vacuum which draws molten matrix metal into the filler material. Moreover, the distribution of reactive atmosphere within the filler material does not have to be substantially uniform, however, a substantially uniform distribution of reactive atmosphere may assist in the formation of a desirable metal matrix composite body.

The inventive method of forming a metal matrix composite body is applicable to a wide variety of filler materials, and the choice of materials will depend largely on such factors as the matrix metal, the processing conditions, the reactivity of molten matrix metal with the reactive atmosphere, the reactivity of the filler material with the reactive atmosphere, the reactivity of molten matrix metal with the impermeable container and the properties sought for the final composite product. For example, when the matrix metal comprises aluminum, suitable filler materials include (a) oxides (e.g., alumina); (b) carbides (e.g., silicon carbide); and (c) nitrides (e.g., titanium nitride). If there is a tendency for the filler material to react adversely with the molten matrix metal, such reaction might be accommodated by minimizing the infiltration time and temperature or by providing a non-reactive coating on the filler. The filler material may comprise a substrate, such as carbon or other non-ceramic material, bearing a ceramic coating to protect the substrate from attack or degradation. Suitable ceramic coatings include oxides, carbides, and nitrides. Ceramics which are preferred for use in the present method include alumina and silicon carbide in the form of particles, platelets, whiskers and fibers. The fibers can be discontinuous (in chopped form) or in the form of continuous filaments, such as multifilament tows. Further, the composition and/or shape of the filler material or preform may be homogeneous or heterogeneous.

The size and shape of the filler material can be any that may be required to achieve the properties desired in the composite. Thus, the material may be in the form of particles, whiskers, platelets or fibers since infiltration is not restricted by the shape of the filler material. Other shapes such as spheres, tubules, pellets, refractory fiber cloth, and the like may be employed. In addition, the size of the material does not limit infiltration, although a higher temperature or longer time period may be required to obtain complete infiltration of a mass of smaller particles than for larger particles. Average filler material sizes ranging from less than 24 grit to about 500 grit are preferred for most technical applications. Moreover, by controlling the size (e.g., particle diameter, etc.) of the permeable mass of filler material or preform, the physical and/or mechanical properties of the formed metal matrix composite may be tailored to meet an unlimited number of industrial applications. Still further, by incorporating a filler material comprising varying particle sizes of filler material, higher packing of the filler material may be achieved to tailor the composite body. Also, it is possible to obtain lower particle loadings, if desired, by agitating the filler material (e.g., shaking the container) during infiltration and/or by mixing powdered matrix metal with the filler material prior to infiltration.

The reactive atmosphere utilized in the method of the present invention may be any atmosphere which may react, at least partially or substantially completely, with the molten matrix metal and/or the filler material and/or the impermeable container, to form a reaction product which occupies a volume which is smaller than that volume occupied by the atmosphere and/or reaction components prior to reaction. Specifically, the reactive atmosphere, upon contact with the molten matrix metal and/or filler material and/or impermeable container, may react with one or more components of the reaction system to form a solid, liquid or vapor-phase reaction product which occupies a smaller volume than the combined individual components, thereby creating a void or vacuum which assists in drawing molten matrix metal into the filler material or preform. Reaction between the reactive atmosphere and one or more of the matrix metal and/or filler material and/or impermeable container, may continue for a time sufficient for the matrix metal to infiltrate, at least partially or substantially completely, the filler material. For example, when air is used as the reactive atmosphere, a reaction between the matrix metal (e.g., aluminum) and air may result in the formation of reaction products (e.g., alumina and/or aluminum nitride, etc.). Under the process conditions, the reaction product(s) tend to occupy a smaller volume than the total volume occupied by the molten aluminum and the air. As a result of the reaction, a vacuum is generated, thereby causing the molten matrix metal to infiltrate the filler material or preform. Depending on the system utilized, the filler material and/or impermeable container may react with the reactive atmosphere in a similar manner to generate a vacuum, thus assisting in the infiltration of molten matrix metal into the filler material. The self-generated vacuum reaction may be continued for a time sufficient to result in the formation of a metal matrix composite body.

In addition, it has been found that a seal or sealing means should be provided to help prevent or restrict gas flow from the ambient atmosphere into the filler material or preform (e.g., prevent flow of ambient atmosphere into the reactive atmosphere). Referring again to FIG. 2, the reactive atmosphere within the impermeable container 32 and filler material 31 should be sufficiently isolated from the ambient atmosphere 37 so that as the reaction between the reactive atmosphere and the molten matrix metal 31 and/or the filler material or preform 33 and/or the impermeable container 32 proceeds, a pressure difference is established and maintained between the reactive and ambient atmospheres until the desired infiltration has been achieved. It will be understood that the isolation between the reactive and ambient atmospheres need not be perfect, but rather only "sufficient", so that a net pressure differential is present (e.g., there could be a vapor phase flow from the ambient atmosphere to the reactive atmosphere so long as the flow rate was lower than that needed immediately to replenish the reactive atmosphere). As described above, part of the necessary isolation of the ambient atmosphere from the reactive atmosphere is provided by the impermeability of the container 32. Since most matrix metals are also sufficiently impermeable to the ambient atmosphere, the molten matrix metal pool 33 provides another part of the necessary isolation. It is important to note, however, that the interface between the impermeable container 32 and the matrix metal may provide a leakage path between the ambient and reactive atmospheres. Accordingly, a seal should be provided that sufficiently inhibits or prevents such leakage.

Suitable seals or sealing means may be classified as mechanical, physical, or chemical, and each of those may be further classified as either extrinsic or intrinsic. By "extrinsic" it is meant that the sealing action arises independently of the molten matrix metal, or in addition to any sealing action provided by the molten matrix metal (for example, from a material added to the other elements of the reaction system); by "intrinsic" it is meant that the sealing action arises exclusively from one or more characteristics of the matrix metal (for example, from the ability of the matrix metal to wet the impermeable container). An intrinsic mechanical seal may be formed by simply providing a deep enough pool of molten matrix metal or by submerging the filler material or preform, as in the above-cited patents to Reding and Reding et al. and those patents related thereto.

Nevertheless, it has been found that intrinsic mechanical seals as taught by, for example, Reding, Jr., are ineffective in a wide variety of applications, and they may require excessively large quantities of molten matrix metal. In accordance with the present invention, it has been found that extrinsic seals and the physical and chemical classes of intrinsic seals overcome those disadvantages of an intrinsic mechanical seal. In a preferred embodiment of an extrinsic seal, a sealing means may be externally applied to the surface of the matrix metal in the form of a solid or a liquid material which, under the process conditions, may be substantially non-reactive with the matrix metal. It has been found that such an extrinsic seal prevents, or at least sufficiently inhibits, transport of vapor-phase constituents from the ambient atmosphere to the reactive atmosphere. Suitable materials for use as extrinsic physical sealing means may be either solids or liquids, including glasses (e.g., boron or silicon glasses, $B_2O_3$, molten oxides, etc.) or any other material(s) which sufficiently inhibit transport of ambient atmosphere to the reactive atmosphere under the process conditions.

An extrinsic mechanical seal may be formed by presmoothing or prepolishing or otherwise forming the interior surface of the impermeable container contacting the pool of matrix metal so that gas transport between the ambient atmosphere and the reactive atmosphere is sufficiently inhibited. Glazes and coatings, such as $B_2O_3$ that may be applied to the container to render it impermeable, can also provide suitable sealing.

An extrinsic chemical seal could be provided by placing a material on the surface of a molten matrix metal that is reactive with, for example, the impermeable container. The reaction product could comprise an intermetallic, an oxide, a carbide, etc.

In a preferred embodiment of an intrinsic physical seal, the matrix metal may react with the ambient atmosphere to form a seal or sealing means having a composition different from the composition of the matrix metal. For example, upon reaction of the matrix metal with the ambient atmosphere a reaction product (e.g., MgO and/or magnesium aluminate spinel in the case of an Al-Mg alloy reacting with air, or copper oxide in the case of a bronze alloy reacting with air) may form which may seal the reactive atmosphere from the ambient atmosphere. In a further embodiment of an intrinsic physical seal, a seal facilitator may be added to the matrix metal to facilitate the formation of a seal upon reaction between the matrix metal and the ambient atmosphere (e.g., by the addition of magnesium, bismuth, lead, etc., for aluminum matrix metals, or by the addition of selenium, tellurium, sulfur, etc., for copper or bronze matrix metals. In forming an intrinsic chemical sealing means, the matrix metal may react with the impermeable container (e.g., by partial dissolution of the container or its coating (intrinsic) or by forming a reaction product or intermetallics, etc.) which may seal the filler material from the ambient atmosphere.

Further, it will be appreciated that the seal should be able to conform to volumetric (i.e., either expansion or contraction) or other changes in the reaction system without allowing ambient atmosphere to flow into the filler material (e.g., flow into the reactive atmosphere). Specifically, as molten matrix metal infiltrates into the permeable mass of filler material or preform, the depth of molten matrix metal in the container may tend to decrease. Appropriate sealing means for such a system should be sufficiently compliant to prevent gas transport from the ambient atmosphere to the filler material as the level of molten matrix metal in the container decreases.

A barrier means may also be utilized in combination with the present invention. Specifically, a barrier means which may be used in the method of this invention may be any suitable means which interferes, inhibits, prevents or terminates the migration, movement, or the like, of molten matrix metal beyond the defined surface boundary of the filler material. Suitable barrier means may be any material, compound, element, composition, or the like, which, under the process conditions of this invention, maintains some structural integrity, is not volatile and is capable of locally inhibiting, stopping, interfering with, preventing, or the like, continued infiltration or any other kind of movement beyond the defined surface boundary of the filler material. Barrier means may be used during self-generated vacuum infiltration or in any impermeable container utilized in connection with the self-generated vacuum technique for forming metal matrix composites, as discussed in greater detail below.

Suitable barrier means include materials which are either wettable or non-wettable by the migrating molten matrix metal under the process conditions employed, so long as wetting of the barrier means does not proceed substantially beyond the surface of barrier material (i.e., surface wetting). A barrier of this type appears to exhibit little or no affinity for the molten matrix alloy, and movement beyond the defined surface boundary of the filler material or preform is prevented or inhibited by the barrier means. The barrier reduces any final machining or grinding that may be required of the metal matrix composite product.

Suitable barriers particularly useful for aluminum matrix metals are those containing carbon, especially the crystalline allotropic form of carbon known as graphite. Graphite is essentially non-wettable by the molten aluminum alloy under the described process conditions. A particularly preferred graphite is the graphite tape product GRAFOIL® which exhibits characteristics that prevent the migration of molten aluminum alloy beyond the defined surface boundary of the filler material. This graphite tape is also resistant to heat and is substantially chemically inert. GRAFOIL® graphite tape is flexible, compatible, conformable and resilient, and it can be made into a variety of shapes to fit most any barrier application. Graphite barrier means may also be employed as a slurry or paste or even as a paint film around and on the boundary of the filler material or preform. GRAFOIL® tape is particularly preferred because it is in the form of a flexible graphite sheet. One method of using this paper-like graphite sheet material is to wrap the filler material or preform to be infiltrated within a layer of the GRAFOIL® material. Alternatively, the graphite sheet material can be formed into a negative mold of a shape which is desired for a metal matrix composite body and this negative mold can then be filled with filler material.

In addition, other finely ground particulate materials, such as 500 grit alumina, can function as a barrier, in certain situations, so long as infiltration of the particulate barrier material would occur at a rate which is slower than the rate of infiltration of the filler material.

The barrier means may be applied by any suitable means, such as by covering the defined surface boundary with a layer of the barrier means. Such a layer of barrier means may be applied by painting, dipping, silk screening, evaporating, or otherwise applying the barrier means in liquid, slurry, or paste form, or by sputtering a vaporizable barrier means, or by simply depositing a layer of a solid particulate barrier means, or by applying a solid thin sheet or film of barrier means onto the defined surface boundary. With the barrier means in place, self-generated vacuum infiltration substantially terminates when the infiltrating matrix metal reaches the defined surface boundary and contacts the barrier means.

The present method of forming a metal matrix composite by a self-generating vacuum technique, in combination with the use of a barrier means, provides significant advantages over the prior art. Specifically, by utilizing the method of the present invention, a metal matrix composite body may be produced without the need for expensive or complicated processing. In one aspect of the present invention, an impermeable container, which may be commercially available or tailored to a specific need, may contain a filler material or preform of a desired shape, a reactive atmosphere and a barrier means for stopping infiltration of the metal matrix composite beyond the surface of the resultant formed composite body. Upon contact of the reactive atmosphere with the matrix metal, which may be poured into the impermeable container, and/or filler material under the process conditions, a self-generated vacuum may be created, thereby causing the molten matrix metal to infiltrate into the filler material. The instant method avoids the need for complex processing steps, e.g., machining of molds into complex shapes, maintaining molten metal baths, removal of formed pieces from complex-shaped molds, etc. Further, displacement of filler material by molten matrix metal is substantially minimized by providing a stable container which is not submerged within a molten bath of metal.

Various demonstrations of the present invention are included in the Examples immediately following. However, these Examples should be considered as being illustrative and should not be construed as limiting the scope of the invention as defined in the appended claims.

EXAMPLE 1

This Example demonstrates that a variety of filler material geometries can be used successfully to form metal matrix composite bodies by the spontaneous infiltration technique. Table I contains summaries of the experimental conditions employed to form a plurality of metal matrix composite bodies, including various matrix metals, filler material geometries, processing temperatures and processing times.

SAMPLE A

A silica mold was prepared, having an inner cavity measuring about 5 inches (127 mm) long by about 5 inches (127 mm) wide by about 3.25 inches (83 mm) deep, and having five holes, about 0.75 inches (19 mm) in diameter and about 0.75 inches (19 mm) deep, in the bottom of the silica mold. The mold was formed by first mixing a slurry comprising by weight about 2.5 to 3 parts silica powder (RANCO-SIL TM 4 from Ransom & Randolph, Maunee, Ohio), about 1 part colloidal silica (Nyacol® 830 by Nyacol Products, Inc., Ashland, Mass.) and about 1 to 1.5 parts silica sand (RANCO-SIL TM A sold by Ransom & Randolph, Maunee, Ohio). The slurry mixture was poured into a rubber mold having a negative shape of the desired inner cavity of the silica mold and placed in a freezer overnight (about 14 hours). The silica mold was subsequently separated from the rubber mold, fired at about 800° C. in an air atmosphere furnace for about 1 hour and cooled to room temperature.

The bottom surface of the formed silica mold was covered with a piece of graphite foil (Perma-Foil from TT America, Portland, Oreg.), having dimensions of about 5 inches (127 mm) long by about 5 inches (127 mm) wide by about 0.010 inches (0.25 mm) thick. Holes, about 0.75 inches (19 mm) in diameter, were cut into the graphite foil to correspond in position to the holes in the bottom of the silica mold. The holes in the bottom of the silica mold were filled with matrix metal cylinders, measuring about 0.75 inches (19 mm) in diameter by about 0.75 inches (19 mm) thick, having a composition identical to the matrix metal, as described below. About 26 grams of a filler material mixture, comprising by weight about 95 percent 220 grit alumina (38 Alundum from Norton, Co., Worcester, Mass.) and about 5 percent −325 mesh magnesium powder (Aesar®, Johnson Matthey, Seabrook, N.H.), was prepared in an about 4 liter plastic jar and hand shaken for about 15 minutes. The filler material mixture was then poured into the bottom of the silica mold to a depth of about 0.75 inch (19 mm) and tapped lightly to level the surface of the filler material mixture. About 1220 grams of a matrix metal, comprising by weight approximately ≦0.25% Si, ≦0.30% Fe, ≦0.25% Cu, ≦0.15% Mn, 9.5–10.6% Mg, ≦0.15% Zn, ≦0.25% Ti and the balance aluminum, was placed on top of the filler material mixture within the silica mold. The silica mold and its contents were then placed into a stainless steel container, having dimensions of about 10 inches (254 mm) long by about 10 inches (254 mm) wide by about 8 inches (203 mm) high. A titanium sponge material, weighing about 15 grams (from Chemalloy Inc., Bryn Mawr, Pa.), was sprinkled around the silica mold in the stainless steel container. A sheet of copper foil was placed over the opening of the stainless steel container, so as to form an isolated chamber. A nitrogen purge tube was provided through the sheet of copper foil, and the stainless steel container and its contents were placed into an air atmosphere resistance heated box furnace.

The furnace was ramped from room temperature to about 600° C. at a rate of about 400° C./hour with a nitrogen flow rate of about 10 liters/minute (note that the isolated chamber is not gas tight and permits some nitrogen to escape therefrom), and then heated from about 600° C. to about 750° C. at a rate of about 400° C./hour with a nitrogen flow rate of about 2 liters/minute. After holding the system at about 775° C. for approximately 1.5 hours with a nitrogen flow rate of about 2 liters/minute, the stainless steel container and its contents were removed from the furnace. The silica mold was removed from the stainless steel container, and a portion of the residual matrix metal was decanted from within the silica mold. A room temperature copper chill plate, about 5 inches (127 mm) long by about 5 inches (127 mm) wide by about 1 inch (25 mm) thick, was placed within the silica mold such that it contacted the top portion of the residual matrix metal, to directionally solidify the formed metal matrix composite.

SAMPLE B

A steel box was formed by placing a steel frame, having inner cavity dimensions of about 5 inches (127 mm) long by about 5 inches (127 mm) wide by about 2.75 inches (70 mm) deep, and having a wall thickness of about 0.3 inch (7.9 mm), onto a steel plate, which measured about 7 inches (178 mm) long by about 7 inches (178 mm) wide by about 0.25 inch (6.4 mm) thick. The steel box was lined with a graphite foil box, measuring about 5 inches (127 mm) long by about 5 inches (127 mm) wide by about 3 inches (76 mm) tall. The graphite foil box was fabricated from a piece of graphite foil (Perma-Foil from TT America, Portland, Oreg.) which was about 11 inches (279 mm) long by about 11 inches (279 mm) wide by about 0.010 inches (0.25 mm) thick. Four parallel cuts, about 3 inches (76 mm) from the side and 3 inches (76 mm) long were made into the graphite foil. The cut graphite foil was then folded and stapled to form the graphite foil box.

About 782 grams of a filler material mixture, comprising by weight about 95 percent alumina (C-75 RG from Alcan Chemicals, Montreal, Canada) and about 5 percent −325 mesh magnesium powder (AESAR®, Johnson Matthey, Seabrook, N.H.) were prepared by combining the materials in a plastic jar and shaking by hand for about 15 minutes. The filler material mixture was then poured into the graphite foil box to a depth of about 0.75 inches (19 mm), and the mixture was tapped lightly to level the surface. The surface of the filler material mixture was coated with about 4 grams of −50 mesh magnesium powder (sold by Alpha Products, Morton Thiokol, Danvers, Mass.). About 1268 grams of a matrix metal, comprising by weight about ≦0.25% Si, ≦0.30% Fe, ≦0.25% Cu, ≦0.15% Mn, 9.5–10.6% Mg, ≦0.15% Zn, ≦0.25% Ti and the balance aluminum, was placed on the filler material mixture coated with the magnesium powder.

The steel box and its contents were placed into a stainless steel container measuring about 10 inches (254 mm) long by about 10 inches (254 mm) wide by about 8 inches (202 mm) high. The bottom of the stainless steel container had been prepared by covering the bottom of the box with a piece of graphite foil measuring about 10 inches (254 mm) long by about 10 inches (254 mm) wide by about 0.010 inch (0.25 mm) thick and a fire brick had been placed on the graphite foil to support the steel box within the stainless steel container. Approximately 20 grams of a titanium sponge material (from Chemalloy Company, Inc., Bryn Mawr, Pa.), was sprinkled onto the graphite foil in the bottom of the stainless steel container around the fire brick supporting the steel box. A sheet of copper foil was placed over the opening of the stainless steel container to form an isolated chamber. A nitrogen purge tube was provided through the sheet of copper foil. The stainless steel container and its contents then placed into a resistance heated air atmosphere box furnace.

The furnace was heated from room temperature to about 600° C. at a rate of about 400° C./hour with a nitrogen flow rate through the tube of about 10 liters/minute, then heated from about 600° C. to about 800° C. at a rate of about 400° C./hour with a nitrogen flow rate of about 2 liters/minute. The system was maintained at about 800° C. for about 2 hours with a nitrogen flow rate of about 2 liters/minute. The stainless steel container and its contents were then removed from the furnace, and the steel box was removed from the stainless steel container and placed onto a room temperature water cooled copper chill plate, having dimensions of about 8 inches (203 mm) long by about 8 inches (203 mm) wide by about 0.5 inches (13 mm) thick, to directionally solidify the metal matrix composite.

SAMPLE C

A graphite boat was provided, having an inner cavity measuring about 12 inches (305 mm) long by about 8 inches (203 mm) wide by about 5.25 inches (13.3 mm) high, made from ATJ graphite manufactured by Union Carbide. Three graphite foil boxes, measuring about 8 inches (203 mm) long by about 4 inches (102 mm) wide by about 5 inches (127 mm) high, were placed in the bottom of the graphite boat. Each graphite foil box was made from a piece of graphite foil (GRAFOIL® from Union Carbide), measuring about 14 inches (356 mm) long by about 12.5 inches (318 mm) wide by about 0.015 inches (0.38 mm) thick. Four parallel cuts, about 5 inches (127 mm) from the side and about 5 inches (127 mm) long, were made into the graphite foil. The cut graphite foil was then folded into a graphite foil box, glued with a mixture comprising by weight about 1 part graphite powder (KS-44 from Lonza, Inc., Fair Lawn, N.J.) and about 3 parts colloidal silica (LUDOX® SM from E. I. du Pont de Nemours & Co., Inc., Wilmington, Del.) and stapled to hold the box together. The bottom of the graphite foil box was uniformly coated with a layer of −50 mesh magnesium powder (sold by Alpha Products, Morton Thiokol, Danvers, Mass.). The magnesium powder was adhered to the bottom of the graphite foil box with a mixture comprising by volume about 25 to 50 percent graphite cement (RIGIDLOCK TM from Polycarbon, Valencia, Calif.) and the balance ethyl alcohol.

About 1000 grams of a filler material mixture, comprising about 98 percent −60 grit tabular alumina (T-64 from Alcoa Industrial Chemicals Division, Bauxite, Ark.) and about 2 percent −325 mesh magnesium powder (AESAR®, Johnson Matthey, Seabrook, N.H.) were placed into a plastic jar and blended on a ball mill for at least 2 hours. The filler material mixture was then poured into the bottom of the graphite foil box lining the graphite boat, hand packed and coated with a 6 gram layer of −50 mesh magnesium powder (Alpha Products, Inc., Morton Thiokol, Danvers, Mass.). About 1239 grams of a matrix metal, comprising by weight about ≦0.35% Si, ≦0.40% Fe, 1.6–2.6% Cu, ≦0.20% Mn, 2.6–3.4% Mg, 0.18–0.35% Cr, 6.8–8.0% Zn, ≦0.20% Ti and the balance aluminum, was placed onto the filler material mixture in the graphite foil box.

The graphite boat and its contents were placed into a room temperature retort lined resistance heated furnace. The retort door was closed and the retort was evacuated to at least 30 inches (762 mm) Hg. After the vacuum had been reached, nitrogen was introduced into the retort chamber at a flow rate of about 2.5 liters/minute. The retort lined furnace was then heated to about 700° C. at a rate of about 120° C./hour and held for about 10 hours at about 700° C. with a flowing nitrogen atmosphere of about 2.5 liters/minute. The retort lined furnace was then ramped from about 700° C. to about 675° C. at a rate of about 150° C./hour. At about 675° C., the graphite boat and its contents were removed from the retort and directional solidification was effected. Specifically, the graphite boat was placed onto a room temperature graphite plate and approximately 500 ml of an external hot-topping material (Feedol®-9, sold by Foseco Inc., Brook Park, Ohio) was poured onto the top of the residual molten matrix metal contained within the graphite foil box, and an about 2 inch (51 mm) thick ceramic fiber blanket (CERABLANKET TM, Manville Refractory Products) was wrapped around the graphite boat. At room temperature, the graphite foil box was disassembled to reveal that a metal matrix composite body had formed.

SAMPLE D

A graphite boat with an inner cavity measuring about 8 inches (203 mm) long by about 4 inches (102 mm) wide by about 2.5 inches (63 mm) deep, made from ATJ graphite manufactured by Union Carbide, was provided. A graphite foil box, having dimensions of about 8 inches (203 mm) long by about 1.5 inches (38 mm) wide by about 3 inches (76 mm) high, was placed into the graphite boat. The graphite foil box was made from a piece of graphite foil (GRAFOIL® from Union Carbide), measuring about 14 inches (356 mm) long by about 7.5 inches (191 mm) wide by about 0.015 inch (0.38 mm) thick. Four parallel cuts about 3 inches (76 mm) from the side and 3 inches (76 mm) long, were made into the graphite foil. The graphite foil was then folded into a graphite foil box, glued with a graphite cement (RIGIDLOCK TM from Polycarbon, Valencia, Calif.) and stapled. Once sufficiently dried, the graphite foil box was placed into the graphite boat.

About 1000 grams of a filler material mixture, comprising by weight about 96 percent alumina platelets measuring about 10 microns in diameter and about 2 microns thick (Developmental Grade F $\alpha Al_2O_3$ platelets supplied by E. I. du Pont de Nemours & Co., Inc., Wilmington, Del.), and about 4 percent −325 mesh magnesium powder (AESAR®, Johnson Matthey, Seabrook, N.H.), were placed into an about 4 liter plastic jar and the remaining volume of the plastic jar was filled with ethyl alcohol to create a slurry mixture. The plastic jar and its contents were then placed on a ball mill for at least 3 hours. The slurry mixture was subjected to vacuum filtration to separate the ethyl alcohol from the filler material mixture. After substantially removing the ethyl alcohol, the filler material mixture was placed into an air oven set at about 110° C. and dried overnight. The filler material mixture was then forced through a 40 mesh sieve to complete its preparation. This liquid dispersion technique will be referred to as the "LD technique" hereinafter.

The bottom of the graphite foil box was coated with an approximately 1.5 gram layer of −50 mesh magnesium powder (Alpha Products, Inc., Morton Thiokol, Danvers, Mass.) and adhered to the bottom of the graphite foil box with a graphite cement (RIGIDLOCK TM) sold by Polycarbon, Valencia, Calif.). The filler material mixture was then poured into the bottom of the graphite foil box, hand packed and coated with a 1.5 gram layer of −50 mesh magnesium powder (Alpha Products, Inc., Morton Thiokol, Danvers, Mass.). Approximately 644 grams of a matrix metal, comprising by weight about ≦0.25% Si, ≦0.30% Fe, ≦0.25% Cu, ≦0.15% Mn, 9.5–10.6% Mg, ≦0.15% Zn, ≦0.25% Ti and the balance aluminum, was placed on the filler material mixture in the graphite foil box. Two graphite support plates, about 8 inches (203 mm) long by about 3 inches (76 mm) wide by about 0.5 inches (13 mm) thick, were placed along the outer sides of the graphite foil box. A 220 grit alumina material, (38 Alundum from Norton Co., Worcester, Mass.), was placed into the graphite boat around the graphite plates.

The system, comprising the graphite boat and its contents, was placed into a room temperature retort lined resistance heated furnace. The retort door was closed, and the retort was evacuated to at least 20 inches (508 mm) Hg. The retort lined furnace was then heated to about 775° C. at a rate of about 100° C./hour with a nitrogen flow rate of about 4 liters/minute. After about 10 hours at about 775° C., with a nitrogen flow rate of about 4 liters/minute, the graphite boat and its contents were removed from the retort furnace and directional solidification was effected. Specifically, the graphite boat was placed onto a room temperature water cooled aluminum quench plate and approximately 500 ml of an external hot-topping material (Feedol®-9, sold by Foseco Inc., Brook Park, Ohio) was poured onto the top of the residual molten matrix metal contained within the graphite foil box, and an about 2 inch (51 mm) thick ceramic fiber blanket (CERABLANKET TM, Manville Refractory Products) was wrapped around the graphite boat. At room temperature, the graphite foil box was disassembled to reveal that a metal matrix composite body had formed.

The formed metal matrix composite was subsequently heat treated. Specifically, the composite was placed into a stainless steel wire basket which was then placed into a resistance heated air atmosphere furnace. The furnace was ramped to about 435° C. in about 40 minutes, held for about 18 hours, and then the composite was removed from the furnace and quenched in a room temperature water bath.

SAMPLE E

A stainless steel box, having dimensions of about 6 inches (152 mm) long by about 3 inches (76 mm) wide by about 5 inches (127 mm) high, was fabricated by welding together sheets of 300 series stainless steel. The stainless steel box was lined with a graphite foil box measuring about 6 inches (152 mm) long by about 3 inches (76 mm) wide by about 5 inches (127 mm) high. The graphite foil box was made from a piece of graphite foil (GRAFOIL® from Union Carbide), measuring about 16 inches long (406 mm) by about 13 inches (330 mm) wide by about 0.015 (38 mm) inches thick. Four parallel cuts, 5 inches (127 mm) from the side and 5 inches (127 mm) long were made into the graphite foil. The graphite foil was then folded and stapled to form the graphite foil box, which was placed inside the stainless steel box.

A filler material mixture was prepared by mixing in a four liter plastic jar approximately 600 grams of a mixture comprising about 73 percent by weight 1000 grit silicon carbide (39 Crystolon from Norton Co., Worcester, Mass.) about 24 percent by weight silicon carbide whiskers (from NIKKEI TECHNO-RESEARCH Co., LTD, Japan) and about 3 percent by weight −325 mesh magnesium powder (AESAR®, Johnson Matthey, Seabrook, N.H.) and placing the jar on a ball mill for approximately one hour.

An approximately 0.75 inch (19 mm) layer of filler material mixture was poured into the bottom of the graphite foil box contained within the stainless steel box. Matrix metal ingots, comprising by weight about 10 percent silicon, 5 percent copper and the balance aluminum, and having a total weight of about 1216 grams, were placed on top of the filler material mixture contained within the graphite foil box. The stainless steel box and its contents were then placed into an outer stainless steel container, measuring about 10 inches (254 mm) long by about 8 inches (203 mm) wide by about 8 inches (203 mm) deep. About 15 grams of a titanium sponge material (from Chemalloy Company, Inc., Bryn Mawr, Pa.), and about 15 grams of a −50 mesh magnesium powder (from Alpha Products, Morton Thiokol, Danvers, Mass.), were sprinkled into the outer stainless steel container around the stainless steel box. A sheet of copper foil was placed over the opening of the outer stainless steel container. A nitrogen purge tube was provided through the copper foil.

The system, comprising the stainless steel container and its contents, was placed into a resistance heated air atmosphere furnace. The furnace was heated from room temperature to about 800° C. at a rate of about 550°

C./hour with a nitrogen flow rate into the stainless steel container of about 2.5 liters/minute. After about 2.5 hours at about 800° C. with a nitrogen flow rate of about 2.5 liters/minute, the outer stainless steel container and its contents were removed from the furnace. The inner graphite foil lined stainless steel box was removed from the outer stainless steel container and the inner box and its contents were placed onto a room temperature copper chill plate, measuring about 8 inches (203 mm) long by about 8 inches (203 mm) wide and about 0.5 inches (13 mm) high, to directionally solidify the metal matrix composite. At room temperature, the graphite foil box was disassembled to reveal that a metal matrix composite had formed.

SAMPLE F

An alumina boat with inner cavity dimensions of about 3.75 inches (95 mm) long by about 1.8 inches (45 mm) wide by about 0.79 inches (20 mm) deep, was used. An approximately ⅛ inch layer of a filler material comprising hollow alumina spheres (Aerospheres, sold by Ceramic Fillers Inc., Atlanta, Ga.), was placed into the bottom of the alumina boat. Matrix metal ingots, comprising by weight about ≦0.25% Si, ≦0.30% Fe, ≦0.25% Cu, ≦0.15% Mn, 9.5–10.6% Mg, ≦0.15% Zn, ≦0.25% Ti and the balance aluminum, were placed onto the layer of filler material in the alumina boat.

The alumina boat and its contents were placed into a room temperature resistance heated tube furnace. The tube furnace was substantially sealed, and the tube was evacuated to at least 30 inches (762 mm) Hg. Subsequently, nitrogen at a flow rate of about 0.5 liters/minute was introduced into the tube, and the tube furnace was heated to about 800° C. at a rate of about 300° C./hour. The system was held at about 800° C. for about 0.5 hours with a nitrogen flow rate of about 0.5 liters/minute. The tube furnace was then cooled to room temperature at a rate of about 300° C./minute. At room temperature, the alumina boat was removed from the tube furnace to reveal that a metal matrix composite body had formed.

SAMPLE G

A graphite boat measuring about 4 inches (102 mm) long by about 4 inches (102 mm) wide by about 3 inches (76 mm) high, made from ATJ graphite manufactured by Union Carbide was provided. A 24 grit alumina material (38 Alundum from Norton Co., Worcester, Mass.), was placed into the bottom of the graphite boat. A graphite foil box, measuring about 2 inches (51 mm) long by about 2 inches (51 mm) wide by about 3 inches (76 mm) high, was placed on the 24 grit alumina coating the bottom of the graphite boat, and the graphite box was surrounded with additional 24 grit alumina. The graphite foil box was made from a piece of graphite foil (GRAFOIL ® from Union Carbide), measuring about 8 inches (203 mm) long by about 8 inches (203 mm) wide by about 0.015 inches (0.38 mm) thick. Four parallel cuts, about 2 inches (51 mm) from the side and about 3 inches (76 mm) long, were made into the graphite foil. The cut graphite foil was then folded, glued with a mixture comprising by weight about 1 part graphite powder (KS-44 from Lonza, Inc., Fair Lawn, N.J.) and about 3 parts colloidal silica (LUDOX ® SM from E. I. du Pont de Nemours & Co., Inc., Wilmington, Del.), and stapled to form the graphite foil box.

An alumina fiber preform, measuring about 2 inches (51 mm) long by about 2 inches (51 mm) wide by about 0.8 inch (20 mm) thick, was made from a mixture comprising by weight about 90 weight percent chopped alumina fibers having a diameter of about 20 μm (Fiber FP ® from E. I. du Pont de Nemours & Company, Inc., Wilmington, Del.), about 10 weight percent alumina fibers having a diameter of about 3 μm (designated Saffil ® from ICI Americas, Wilmington, Del.), and which was bonded with a colloidal alumina. The alumina fiber preform, which comprised approximately 12 volume percent ceramic fibers, was placed into the bottom of the graphite foil box in the graphite boat. Two ingots of matrix metal, each having dimensions of about 2 inches (51 mm) long by about 2 inches (51 mm) wide by about I inch (25 mm) high, and comprising by weight about 10.5% Mg, 4% Zn, 0.5% Si, 0.5% Cu and the balance aluminum, were placed on the alumina fiber preform in the graphite foil box. The space between the perimeter of the preform and the side walls of the graphite foil box was filled with a pasty graphite mixture, comprising by weight about 1 part graphite powder (KS-44 sold by Lonza, Inc., Fair Lawn, N.J.) and about 3 parts colloidal silica (LUDOX ® SM, sold by E. I. du Pont de Nemours & Co., Inc., Wilmington, Del.).

The graphite boat and its contents were placed into a room temperature controlled atmosphere furnace. The furnace door was closed, and the furnace was evacuated to at least 30 inches (762 mm) Hg. The furnace was then heated to about 200° C. in about 0.75 hours. After at least 2 hours at about 200° C., with a vacuum of at least 30 inches (762 mm) Hg, the furnace was backfilled with nitrogen at a flow rate of about 2 liters/minute and heated to about 675° C. in about 5 hours. After about 20 hours at about 675° C., with a nitrogen flow rate of about 2 liters/minute the furnace was turned off and cooled to room temperature. At room temperature, the graphite foil box was disassembled to reveal that a metal matrix composite body had formed.

SAMPLE H

A stainless steel container, about 6.5 inches (165 mm) long by about 6.5 inches (165 mm) wide by about 3 inches (76 mm) high, was made by welding together sheets of series 300 stainless steel. The stainless steel container was lined with a graphite foil box, measuring about 6 inches (152 mm) long by about 6 inches (152 mm) wide by about 3 inches (76 mm) high. The graphite foil box was made from a piece of graphite foil (GRAFOIL ® from Union Carbide), measuring about 9 inches (229 mm) long by about 9 inches (229 mm) wide by about 0.015 inches (0.38 mm) thick. Four parallel cuts, 3 inches (76 mm) from the side and 3 inches (76 mm) long were made into the graphite foil. The cut graphite foil was then folded, glued with a mixture comprising by weight about 1 part graphite powder (KS-44, sold by Lonza, Inc., Fair Lawn, N.J.) and about 3 parts colloidal silica (LUDOX ® SM sold by E.I. du Pont de Nemours & Co., Inc., Wilmington, Del.), and stapled to form the graphite foil box. After the glue had substantially dried, the graphite foil box was placed into the bottom of the stainless steel container. An approximately 0.25 inch (6.4 mm) thick layer of 90 grit SiC (39 Crystolon from Norton Co., Worcester, Mass.), was poured into the bottom of the graphite foil box.

A continuous fiber preform, measuring about 6 inches (152 mm) long by about 6 inches (152 mm) wide by about 0.5 inches (13 mm) thick, made from alumina fiber having a diameter of about 20 μm (Fiber Fp ® sold by E. I. du Pont de Nemours & Company, Inc. of Wilmington, Del.) was placed on top of the layer of 90 grit SiC in the graphite foil box lining the stainless steel container. A graphite foil sheet (GRAFOIL ® from Union Carbide), measuring approximately 6 inches (152 mm) by 6 inches (152 mm) by 0.015 inches (0.38 mm) and with an approximately 2 inch (51 mm) diameter hole in the center of the graphite sheet 7 was placed on the continuous fiber preform. Matrix metal ingots, each measuring about 3.5 inches (89 mm) long by about 3.5 inches (89 mm) wide by about 0.5 inch (13 mm) thick, and comprising by weight about ≦0.25% Si, ≦0.30% Fe, ≦0.25% Cu, ≦0.15% Mn, 9.5–10.6% Mg, ≦0.15% Zn, ≦0.25% Ti and the balance aluminum, were placed onto the graphite sheet.

The stainless steel container and its contents were placed into a room temperature resistance heated retort lined furnace. The retort door was closed, and the retort was evacuated to at least 30 inches (762 mm) Hg. The retort lined furnace was then heated to about 200° C. in about 0.75 hours. After about 2 hours at about 200° C. with a vacuum of about 30 inches (762 mm) Hg, the evacuated retort was backfilled with nitrogen at a flow rate of about 2.5 liters/minute. The retort lined furnace was then heated to about 725° C. at a rate of about 150° C./hour with a nitrogen flow rate of about 2.5 liters/minute. The system was held at about 725° C. for about 25 hours with a nitrogen flow rate of about 2.5 liters/minute. The stainless steel container and its contents were then removed from the retort. Directional solidification was then effected by placing the stainless steel container onto graphite plates, and pouring 90 grit alumina (38 Alundum sold by Norton Co., Worcester, Mass.), which had been preheated to at least 700° C., onto the residual molten matrix metal, and then covering the stainless steel container and its contents with a ceramic fiber blanket (CERABLANKET TM, Manville Refractory Products). At room temperature, the setup was disassembled to reveal that a continuous fiber reinforced metal matrix composite had formed.

SAMPLE I

A graphite boat, measuring about 22.75 inches (578 mm) long by about 9.75 inches (248 mm) wide by about 6 inches (152 mm) high, made from ATJ graphite sold by Union Carbide, was used. A graphite foil box, measuring about 17 inches (452 mm) long by about 1 inch (25 mm) wide by about 1 inch (25 mm) high was made from a piece of graphite foil (GRAFOIL ® from Union Carbide), as described in Sample G.

The graphite foil box was placed into the graphite boat and surrounded with 24 grit alumina (38 Alundum sold by Norton Co., Worcester, Mass.). A layer of loose CVD silicon carbide-coated graphite fibers (Thornel T 300 Grade 309 ST Carbon Pitch Fibers, Amoco Performance Products, Inc.) was placed into the bottom of the graphite foil box. The same graphite powder/colloidal silica mixture used to glue the graphite foil box together was used to coat the ends of the CVD silicon carbide-coated graphite fibers. A matrix metal ingot, measuring about 12 inches (305 mm) long by about 0.75 inches (19 mm) wide by about 1 inch (25 mm) thick, and comprising by weight about 6% Mg, 5% Zn, 12% Si and the balance aluminum, was placed onto the loose silicon carbide-coated graphite fibers in the graphite foil box. The graphite boat and its contents were placed into a room temperature controlled atmosphere furnace. The furnace door was closed, and the chamber was evacuated to at least 30 inches (762 mm) Hg, while at room temperature. The furnace was then heated to about 200° C. in about 0.75 hour. After about 2 hours at about 200° C. with a vacuum of at least 30 inches (762 mm) Hg, the furnace was backfilled with nitrogen at a rate of about 1.5 liters/minute. The furnace was then ramped to about 850° C. in about 5 hours. After about 10 hours at about 850° C., with a nitrogen atmosphere flowing at about 1.5 liter/minute, the furnace was cooled to room temperature in about 3 hours. At room temperature, the graphite foil box was disassembled to reveal the formed metal matrix composite.

TABLE I

| Sample | Matrix Metal | Filler Material | Processing Time (Hrs.) | Processing Temp. (°C.) |
|---|---|---|---|---|
| A | 520+ | 220# fused $Al_2O_3$[1] | 1.5 | 775 |
| B | 520.0+ | calcined $Al_2O_3$[2] | 2.0 | 800 |
| C | 7000# | tabular $Al_2O_3$[3] | 10 | 700 |
| D | 520.0+ | $Al_2O_3$ *Platelets*[4] | 10 | 775 |
| E | Al-10Si-5Cu | SiC Whiskers[5] & 100# SiC particulate[6] | 2.5 | 775 |
| F | 520.0+ | $Al_2O_3$ Microspheres[7] | 0.5 | 800 |
| G | Al-10.5Mg-4Zn-.5Si-.5Cu | $Al_2O_3$ chopped fibers[8]&[9] | 20 | 675 |
| H | 520.0+ | $Al_2O_3$ continuous fibers[8] | 25 | 725 |
| I | Al-12Si-6Mg-5Zn | SiC coated carbon[10] | 10 | 850 |

[1]38 Alundum, Norton Co., Worcester, MA.
[2]C-75 RG, Alcan Chemicals, Montreal, Canada.
[3]T-64 tabular alumina, Alcoa, Pittsburgh, PA.
[4]Developmental Grade F $\alpha Al_2O_3$ Platelets, E. I. DuPont de Nemours & Co., Inc., Wilmington, DE.
[5]NIKKEI TECHNO-RESEARCH Co., LTD, Japan.
[6]39 Crystolon, Norton Co., Worcester, MA.
[7]Aerospheres, Ceramic Fillers Inc., Atlanta, GA.
[8]Fiber FP ® alumina fibers, E. I. du Pont de Nemours & Co., Inc., Wilmington, DE.
[9]Saffil ® alumina fibers, ICI Americas, Wilmington, DE.
[10]Thornel ® T 300 Grade 309 ST Carbon Pitch Fibers, Amoco Performance Products, Inc., Greenville, SC.
+≦0.25% Si, ≦0.30% Fe, ≦0.25% Cu, ≦0.15% Mn, 9.5–10.6% Mg, ≦0.15% Zn, ≦0.25% Ti and the balance aluminum.
#≦0.35% Si, ≦0.40% Fe, 1.6–2.6% Cu, ≦0.20% Mn, 2.6–3.4% Mg, 0.18–0.35% Cr, 6.8–8.0% Zn, ≦0.26% Ti and the balance aluminum.

EXAMPLE 2

This Example demonstrates that a variety of filler material compositions can be used successfully to form metal matrix composite bodies by the spontaneous infiltration technique. Table II contains a summary of the experimental conditions employed to form metal matrix composite bodies using various matrix metals, filler materials, processing temperatures and processing times.

SAMPLES A–D

Samples A–D, as discussed in Example 5, were formed using a fused alumina filler material, calcined alumina filler material, tabular alumina filler material, and platelet alumina filler material, respectively. Each of Samples A–D are contained in Table II.

SAMPLE J

A graphite foil box, about 4 inches (102 mm) long by about 4 inches (102 mm) wide and about 3 inches (76 mm) tall (made from GRAFOIL ®, a product of Union Carbide Corporation) was placed into a graphite boat. Approximately 300 grams of magnesium oxide powder (TECO MgO, Grade 120S, C-E Minerals, Greenville, S.C.) was placed into the bottom of the graphite foil box lining the graphite boat. The surface of the magnesium oxide powder was substantially covered with −50 mesh magnesium powder (from Alpha Products, Inc., Morton Thiokol, Danvers, Mass.). A matrix metal ingot comprising by weight about ≦0.25% Si, ≦0.30% Fe, ≦0.25% Cu, ≦0.15% Mn, 9.5–10.6% Mg, ≦0.15% Zn, ≦0.25% Ti and the balance aluminum, and measuring about 4.5 inches (114 mm) long by about 1.5 inches (38 mm) wide by about 1.5 inches (38 mm) tall, was placed on the −50 mesh magnesium powder located on the surface of the magnesium oxide powder in the graphite foil box.

The graphite boat and its contents were placed into a retort lined resistance heated furnace. The retort door was closed and at room temperature, the retort was evacuated to at least 30 inches (762 mm) Hg. After the vacuum was attained, the furnace was backfilled with nitrogen at a flow rate of about 4 liters/minute. The retort lined furnace was then heated to about 750° C. at a rate of about 200° C./hour with a nitrogen flow rate of about 4 liters/minute. After about 19 hours at about 750° C. with a nitrogen flow rate of about 4 liters/minute, the retort lined furnace was cooled to about 650° C. at a rate of about 200° C./hour. At about 650° C., the retort door was opened, and the graphite boat and its contents were removed and placed into contact with a graphite plate to directionally solidify the metal matrix composite and the residual matrix metal. At room temperature, the graphite foil box was disassembled to reveal that a metal matrix composite containing a magnesium oxide filler had been formed.

SAMPLE K

A steel mold having a trapezoidal cross-section with closed-end dimensions measuring about 3 inches (76 mm) long and 3 inches (76 μm) wide, open-end dimensions measuring about 3.75 inches (95 mm) long and 3.75 inches (95 mm) wide, and a height of about 2.5 inches (64 mm), was made from 14 gauge (1.9 mm) thick carbon steel. The inner surface of the steel mold was coated with a graphite mixture comprising about 1.5 parts by volume ethanol (from Pharmco Products, Inc., of Byon, N.J.) and about 1 part by volume DAG-154 colloidal graphite (from Atcheson Colloid, Port Huron, Miss.). At least three coats of the graphite mixture were applied with an air brush onto the inner surface of the container. Each coat of the graphite mixture was permitted to dry before a subsequent coat was applied. The steel mold was placed into a resistance heated air atmosphere furnace set at about 330° C. for about 2 hours to dry and adhere the colloidal graphite coating to the steel mold.

About 2.2 lbs (1 kg) of a partially stabilized zirconia (HSY-3SD, Zirconia Sales, Inc., Atlanta, Ga.) was prefired in an alumina crucible, measuring about 7 inches (177.8 mm) high with an upper diameter of about 6.25 inches (159 mm), and a bottom diameter of about 3.75 inches (95 mm), for about 1 hour at about 1350° C. A filler material mixture was made by mixing in a 4 liter plastic jar approximately 600 grams of a mixture comprising about 95 percent by weight prefired $ZrO_2$ and about 5 percent by weight −325 mesh magnesium powder (from Reede Manufacturing Company, Lake Hurst, N.J.). The mixture was ball milled for approximately 1 hour, then hand shaken for an additional 10 minutes.

A layer of filler material mixture was poured into the bottom of the colloidal graphite-coated mold to a depth of about 0.75 inches (19 mm). The filler material was substantially covered with a layer of −50 mesh Mg powder (from Alpha Products, Morton Thiokol, Danvers, Mass.). Matrix metal ingots comprising about 99.7 percent by weight aluminum and the balance trace elements, with a total weight of about 537 grams, were placed on top of the filler material mixture and the magnesium powder layer within the colloidal graphite-coated steel mold. An additional 16.9 grams of a second matrix metal, comprising about 15 percent by weight silicon and the balance aluminum, was added to the top of the original matrix metal. The mold and its contents were then placed into an outer carbon steel container, measuring about 12 inches (305 mm) long by about 10 inches (254 mm) wide by about 10 inches (254 mm) high. A piece of graphite foil (designated PF-25-H and sold under the trade name Perma-Foil from TT America, Portland, Oreg.) measuring about 12 inches (305 mm) long by about 10 inches (254 mm) wide with a thickness of about 0.01 inch (0.25 mm), covered the bottom of the inner cavity of the outer carbon steel container. A titanium sponge material weighing about 20 grams (from Chemalloy Company, Inc., Bryn Mawr, Pa.) and about 0.8 grams of −50 mesh magnesium powder (Alpha Products, Inc., Morton Thiokol, Danvers, Mass.), were sprinkled into the outer carbon steel container around the colloidal graphite coated steel mold and on the graphite foil. A sheet of copper foil was placed over the opening of the outer steel container. A nitrogen purge tube was provided in the side wall of the outer carbon steel container. The outer steel container and its contents were placed into a resistance heated utility furnace. The furnace was ramped from room temperature to about 600° C. at a rate of about 400° C./hour with a nitrogen flow rate of about 10 liters/minute, and then from about 600° C. to about 800° C. at a rate of about 400° C./hour with a nitrogen flow rate of about 2 liters/minute. The furnace was held at about 800° C. for about 1 hour with a nitrogen flow rate of about 2 liters/minute. The outer carbon steel container and its contents were then removed from the furnace, and the colloidal graphite-coated steel mold was removed from the outer steel container and contacted with a room temperature copper chill plate, measuring about 8 inches (203 mm) long by 8 inches (203 mm) wide by 0.5 inches (13 mm) high, to directionally solidify the formed metal matrix composite.

SAMPLE L

A mold having a trapezoidal cross-section was prepared in a manner identical to that of Sample K, except that the mold was fired for 2 hours to set the colloidal graphite coating.

Approximately 2.2 lbs (1 kg) of a $ZrO_2$ toughened $Al_2O_3$ (ZTA-85, Zirconia Sales, Inc., Atlanta, Ga.) was prepared in a manner identical to that of the filler material in Sample K. A layer of filler material mixture was poured into the bottom of the colloidal graphite-coated steel mold to a depth of about 0.75 inches (19 mm). The filler material was substantially covered with a layer of −50 mesh magnesium powder (from Alpha Products, Morton Thiokol, Danvers, Mass.). Matrix metal ingots comprising about 99.7 percent by weight aluminum and the balance trace elements, and weighing about 368 grams, were placed on top of the filler material mixture which was covered with the magnesium powder. A second matrix metal comprising by weight about 15 percent silicon and the balance aluminum, and weighing about 17.11 grams, was placed on top of the first matrix metal. The colloidal graphite-coated steel mold and its contents were placed into an outer carbon steel container, about 12 inches (305 mm) long by about 10 inches (254 mm) wide by about 10 inches (254 mm) high. A piece of graphite tape product (designated PF-25-H and sold under the trade name Perma-Foil from TT America, Portland, Oreg.), measuring about 12 inches (305 mm) long by about 10 inches (254 mm) wide with a thickness of about 0.01 inch (0.25 mm), covered the bottom of the inner cavity of the outer carbon steel container. A titanium sponge material weighing about 20 grams (from Chemalloy Company, Inc., Bryn Mawr, Pa.), and about 2 grams of a −50 mesh magnesium powder, were sprinkled around the colloidal graphite-coated mold and on the graphite tape product within the outer carbon steel container . A sheet of copper foil was placed over the opening of the outer carbon steel container. A nitrogen purge tube was provided in the side wall of the outer carbon steel container.

The covered steel container and its contents were placed into a resistance heated utility furnace. The furnace was ramped from room temperature to about 600° C. at a rate of about 400° C./hour with a nitrogen flow rate of about 10 liters/minute, and then from about 600° C. to about 800° C at a rate of about 400° C./hour with a nitrogen flow rate of about 2 liters/minute. The furnace was held at about 800° C. for about I hour with a nitrogen flow rate of about 2 liters/minute, and then cooled to about 580° C. The outer carbon steel container and its contents were then removed from the furnace, and the colloidal graphite-coated steel mold was removed from the outer carbon steel container to a room temperature copper chill plate, measuring about 8 inches (203 mm) long by about 8 inches (203 mm) wide by about 0.5 inches (13 mm) high, to directionally solidify the formed metal matrix composite.

SAMPLE M

A graphite boat was provided, having inner cavity dimensions of about 12 inches by about 9 inches by about 5.5 inches high (ATJ Grade from Union Carbide, manufactured by MGP, Inc., Womelsdorf, Pa.). An approximately 8 inch (203 mm) by 4 inch (102 mm) wide by 3 inch (76 mm) deep graphite foil box (GRAFOIL ® from Union Carbide) was formed, as described in Sample C. Approximately 1 gram of −50 mesh magnesium powder (from Alpha Products, Inc., Morton Thiokol, Danvers, Mass.) was placed in the bottom of the box. A light coating (not shown in FIG. 19) of graphite cement (RIGIDLOCK ® from Polycarbon, Valencia, Calif.) was provided on the bottom of the graphite foil box to adhere the magnesium powder to the bottom of the box.

A filler material mixture was prepared by mixing approximately 763 grams of a mixture comprising by weight about 98 percent, 1000 mesh silicon carbide (39 Crystolon from Norton Co., Worcester, Mass.) and about 2 weight percent, −325 mesh magnesium powder (Aesar ®, Johnson Matthey, Seabrook, N.H.) in a slurry of ethanol (by the LD technique discussed in Sample D of Example 1). This filler material mixture was then placed into the graphite box on top of the magnesium powder.

A layer of graphite foil (GRAFOIL ® from Union Carbide) having dimensions of approximately 8 inches (203 mm) by 4 inches (102 mm) wide by 0.015 inches (0.38 mm) thick, and having an approximately 1.25 inch (32 mm) diameter hole in the center of the graphite foil, was placed onto the surface of the silicon carbide filler material within the graphite boat. Approximately I gram of −50 mesh magnesium powder (from Alpha Products, Inc., Morton Thiokol, Danvers, Mass.) was placed onto the exposed surface of the filler material over the hole in the graphite foil.

A matrix metal ingot weighing approximately 1237 grams and comprised of a 413.0 alloy (having a nominal composition of approximately 11.0–13.0% Si, ≦2.0% Fe, ≦1.0% Cu, ≦0.35% Mn, ≦1.0% Mg, ≦0.50% Ni, ≦0.50% Zn, ≦0.15% Sn and the balance aluminum) was placed onto the surface of the graphite foil , such that the alloy covered the hole in the graphite sheet.

The reaction system, comprising the boat and its contents, was placed into a retort lined resistance heated furnace. The furnace was evacuated to at least 20 inches (508 mm) Hg, then backfilled with nitrogen gas at a flow rate of approximately 4.5 liters/minute. The furnace temperature was ramped from room temperature to approximately 775° C. at a rate of about 200° C./hour. The system was held at approximately 775° C. for approximately 20 hours, then ramped down to about 760° C. at a rate of about 150° C./hour. At a temperature of approximately 760° C., the system was removed from the furnace and placed onto a water cooled aluminum quench plate. Approximately 500 ml of an exothermic hot-topping material (Feedal ®-9, Foseco, Inc., of Brook Park, Ohio) was sprinkled on top of the setup, and a ceramic fiber blanket (CERABLANKET, Manville Refractory Products) was wrapped around the graphite boat. The Feedal ®-9 was utilized to create an exothermic reaction on top of the setup to force the metal matrix composite to solidify directionally as it cooled, thus inhibiting the formation of shrinkage porosity within the metal matrix composite.

SAMPLE N

Two ATJ Grade graphite plates measuring approximately 8 inches (203 mm) long by 3 inches (76 mm) wide by 0.5 inches (0.3 mm) thick were placed into an approximately 8 inch (203 mm) by 4 inch (102 mm) by 3 inch (76 mm) high graphite boat to form a cavity within a graphite boat having dimensions of approximately 8 inches (203 mm) by 2 inches (50.8 mm) by 3 inches (76 mm) high. The portion of the graphite boat outside of the graphite plates was filled with 220 grit alumina (38 Alundum from Norton Company). Into the cavity between the alumina plates was placed an approximately 8 inch (203 mm) by 2 inch (50.8 mm) by 3 inch (76 mm) graphite foil box (GRAFOIL® from Union Carbide) which was formed as described in Sample C. Into the inner portion of the graphite foil box was placed approximately 1.5 grams of −50 mesh magnesium powder (Alpha Products, Inc., Morton Thiokol, Danvers, Mass.), adhered to the bottom of the graphite foil box with a graphite cement (RIGIDLOCK TM from Polycarbon, Ltd., Valencia, Calif.).

A silicon carbide platelet filler material mixture was prepared by the LD technique, described in Sample D of Example 1, whereby approximately 303 grams of a mixture of about 96 percent by weight silicon carbide platelets, having a diameter of about 50 microns and a thickness of about 10 microns, (C-Axis Technology, Ltd., Jonquiere, Quebec, Canada) and about 4 percent by weight −325 mesh magnesium powder (Aesar®, Johnson Matthey, Seabrook, N.H.) was prepared. This filler material mixture was placed on top of the magnesium layer in the graphite boat. A second layer of approximately 1.5 grams of −50 mesh magnesium powder (Alpha Products, Morton Thiokol, Danvers, Mass.) was placed on top of the silicon carbide filler material mixture. An ingot weighing approximately 644 grams and comprised of a 413.0 alloy, having a composition as set forth at the bottom of Table II, was placed on top of the magnesium layer in the system.

The system, comprising the graphite boat and its contents, was placed into a retort lined resistance heated tube furnace. The furnace was evacuated to at least −20 inches (508 mm) Hg, then backfilled with nitrogen gas at a flow rate of approximately 4.0 liters/minute. The temperature in the oven was ramped from room temperature to approximately 775° C. at a rate of about 100° C./hour. The system was held at approximately 775° C. for about 10 hours, then ramped down to about 760° C. at a rate of about 200° C./hour. The system was removed from the furnace at approximately 760° C. and placed on a water cooled aluminum quench plate. Approximately 500 ml of an exothermic hot-topping material (Feedal®-9 from Foseco, Inc., of Brook Park, Ohio) was sprinkled on top of the setup, and a ceramic fiber blanket was wrapped around the surface of the graphite boat. The Feedal®-9 was utilized to create an exothermic reaction on top of the setup to force the metal matrix composite to solidify directionally as it cooled, thus inhibiting the formation of shrinkage porosity within the metal matrix composite.

SAMPLE O

A graphite boat was provided, having inner cavity dimensions of about 12 inches by about 9 inches by about 5.5 inches high (ATJ Grade from Union Carbide, manufactured by MGP, Inc., Womelsdorf, Pa.). An approximately 8 inch (203 mm) by 4 inch (102 mm) wide by 3 inch (76 mm) deep graphite foil box (GRAFOIL® from Union Carbide) was formed, as described in Sample C. Approximately I gram of −50 mesh magnesium powder (from Alpha Products, Inc., Morton Thiokol, Danvers, Mass.) was placed on the bottom of the graphite foil box. A light spray coating of graphite cement (RIGIDLOCK® from Polycarbon, Valencia, Calif.) was provided on the bottom of the graphite foil box to adhere the magnesium powder to the bottom of the box.

A filler material was prepared by mixing approximately 94 percent by weight titanium diboride platelets, having a diameter of about 10 microns and a thickness of about 2.5 microns (HTC-30 from Union Carbide) and approximately 6 percent by weight of −325 mesh magnesium powder (Aesar® from Johnson Matthey, Seabrook, N.H.) by the LD technique, as described in Sample D of Example 1. This filler material mixture was then poured on top of the magnesium powder in the graphite foil box.

An approximately 8 inch (203 mm) by 4 (102 mm) inch by 0.015 (0.38 mm) inch thick graphite foil (GRAFOIL® from Union Carbide), having a hole of approximately 1.25 inches (32 mm) in diameter in the center of the foil, was placed on top of the filler material. Approximately 1 gram of −50 mesh magnesium powder (Alpha Products, Morton Thiokol, Danvers, Mass.) was placed onto the exposed surface of the filler material through the hole in the graphite sheet. A matrix metal ingot of approximately 1498 grams of 520 alloy (comprising by weight about ≦0.25% Si, ≦0.35% Fe, ≦0.25% Cu, ≦0.15% Mn, 9.5–10.6% Mg, ≦0.15% Zn, ≦0.25% Ti, and the balance aluminum) was placed on top of the graphite foil sheet.

The graphite boat and its contents were placed into a room temperature retort lined resistance heated furnace. The retort door was closed, and the retort was evacuated to at least 20 inches (508 mm) Hg. The retort was then backfilled with nitrogen at a flow rate of about 4.5 liters/minute. The retort lined furnace was then heated from room temperature to about 775° C. at a rate of about 200° C./hour. After about 20 hours at about 775° C., the retort lined furnace was cooled to about 760° C. at a rate of about 150° C./hour. At about 760° C., the retort door was opened and the graphite boat and its contents were removed from the retort onto a room temperature water cooled aluminum chill plate, having dimensions of about 12 inches (305 mm) long by about 9 inches (229 mm) wide by about 2 inches (51 mm) thick. Approximately 500 ml exothermic hot-topping material (Feedal®-9 from Foseco, Inc., of Brook Park, Ohio) was sprinkled on top of the setup, and a ceramic fiber blanket (CERABLANKET, Manville Refractory Products) was wrapped around the surface of the graphite boat. The hot-topping material was utilized to create an exothermic reaction on top of the residual matrix metal to help force the metal matrix composite to solidify directionally as it cooled, thus inhibiting the formation of shrinkage porosity within the metal matrix composite.

SAMPLE P

A stainless steel container having dimensions of approximately 6 inches (152 mm) long by 6 inches (152 mm) wide by 7.5 inches (191 mm) deep was lined with a graphite foil box having dimensions of approximately 6 inches (152 mm) by 6 inches (152 mm) by 7.5 inches (191 mm), prepared in accordance with the above-described examples. Approximately 2 grams of −325 mesh magnesium powder (Aesar® from Johnson Matthey, Seabrook, N.H.) was adhered to the bottom of the graphite box with graphite cement (RIGIDLOCK TM from Polycarbon, Valencia, Calif.). An approximately 500 gram mixture of about 95 percent by weight aluminum nitride powder, having an average particle size diameter of about 3–6 microns, (A-200 AlN from Advanced Refractory Technology, Inc., Buffalo, N.Y.) and about 5 percent by weight 325 mesh magnesium powder (Aesar® from Johnson Matthey, Seabrook, N.H.), was mixed by mechanical means in a four liter plastic jar for at least 2 hours to obtain an uniform filler material mixture. This filler material mixture was placed into the graphite foil box. An approximately 1 inch (25 mm) long graphite tube gate having an inner diameter of about 2 inches (51 mm) was placed on top of the filler material. A loose bed of 220 grit alumina (E 38 Alundum from Norton Co.) was poured around the outer diameter of the graphite tube gate which had been centered on top of the filler material within the graphite box. Sufficient 220 grit alumina was added to substantially surround the graphite tube gate. Approximately 5 grams of −50 mesh magnesium powder (Alpha Products, Morton Thiokol, Danvers, Mass.) was placed into the inner portion of the graphite tube gate to cover the interface of the filler material. Approximately 1210 grams of a matrix metal alloy, having a nominal composition of 413.0, comprising by weight about 11.0–13.0% Si, ≦2.0% Fe, ≦1.0% Cu, ≦0.35% Mn, ≦0.10% Mg, ≦0.50% Ni, ≦0.50% Zn, ≦0.15% Sn and the balance aluminum, was placed on top of the reaction components, as shown in FIG. 20.

The system, comprising the steel container and its contents, was placed into a retort lined resistance heated furnace, and the furnace was evacuated to at least −20 inches (508 mm) Hg and backfilled with nitrogen gas flowing at a rate of approximately 4.0 liters/minute. The furnace was ramped from room temperature to about 200° C. at a rate of approximately 200° C./hour, held at about 200° C. for approximately 49 hours, then ramped to approximately 550° C. at a rate of about 200° C./hour, held at approximately 550° C. for about 1 hour, then ramped to about 775° C. at a rate of approximately 150° C./hour. The system was held at approximately 775° C. for about 10 hours, then ramped down to about 760° C. at a rate of approximately 150° C./hour. At approximately 760° C. the system was removed from the furnace and directionally cooled by hot-topping. Specifically, the system was placed onto a water cooled aluminum chill plate having dimensions of about 12 inches (305 mm) long by about 9 inches (229 mm) wide by about 2 inches (51 mm) thick. Approximately 500 ml of an exothermic hot-topping material (Feedal®-9 from Foseco, Inc., of Brook Park, Ohio) was sprinkled on top of the setup. A ceramic fiber blanket (CERABLANKET, Manville Refractory Products) was wrapped around the stainless steel container to insulate the system. The hot-topping material was utilized to create an exothermic reaction on top of the residual matrix metal to assist the metal matrix composite to solidify directionally as it cooled, thus inhibiting the formation of shrinkage porosity within the metal matrix composite.

Mechanical properties of some of the metal matrix composite bodies formed in accordance with this Example are shown in Table II. A description of the methods used to determine the mechanical properties is provided below.

Measurement of Ultimate Tensile Strength (U.T.S.).. The tensile strength of some metal matrix composites was determined using ASTM #B557-84 "Standard Methods of Tension Testing Wrought and Cast Aluminum and Magnesium Products". Rectangular tension test specimens having dimensions of 6 inches (154 mm) long by 0.5 inch (13 mm) wide and 0.1 inches (2.5 mm) thick were used. The gauge section of the rectangular tensile test specimens was about ⅜ inch (10 mm) wide by about 0.75 inches (19 mm) long and the radii from end section to the gauge section were about 3 inches (76 mm). Four aluminum gripping tabs, about 2 inches (51 mm) long by about 0.5 inch (13 mm) wide and about 0.3 inches (7.6 mm) thick, were fastened to the end sections of each rectangular tension test specimens with an epoxy (designated Epoxy-patch TM, Dexter Corporation of High Sol Aerospace and Industrial Products, Seabrook, N.H.). The strain of the rectangular tension test specimens was measured with strain gauges (350 ohm bridges) designated CEA-06-375UW-350 from Micromeasurements of Raleigh, N.C. The rectangular tension test specimens, including the aluminum gripping tabs and strain gauges, were placed in wedge grips on a Syntec 5000 pound (2269 kg) load cell (Universal Testing Machine, Model No. CITS 2000/6 manufactured by System Integration Technology Inc. of Straton, Mass.). A computer data acquisition system was connected to the measuring unit, and the strain gauges recorded the test responses. The rectangular tension test specimens were deformed at a constant rate of 0.039 inches/minute (1 mm/minute) to failure. The maximum stress, maximum strain and strain to failure were calculated from the sample geometry and recorded responses with programs within the computer.

Measurement of Modulus by the Resonance Method

The elastic modulus of the metal matrix composites was determined by a sonic resonance technique which is substantially the same as ASTM method C848-88. Specifically, a composite sample measuring from about 1.8 to 2.2 inches long, about 0.24 inches wide and about 1.9 inches thick (about 45 mm to about 55 mm long, about 6 mm wide and about 4.8 mm thick) was placed between two transducers isolated from room vibrations by an air table supporting a granite stone. One of the transducers was used to excite frequencies within the composite sample while the other was used to monitor the frequency response of the metal matrix composite. By scanning through frequencies, monitoring and recording the response levels for each frequency, and noting the resonant frequency the elastic modulus was determined.

Measurement of the Fracture Toughness for Metal Matrix Material

Using a Chevron Notch Specimen

The method of Munz, Shannon and Bubsey, was used to determine the fracture toughness of metal matrix materials. The fracture toughness was calculated from the maximum load of Chevron notch specimen in four point loading. Specifically, the geometry of the Chevron notch specimen was about 1.8 to 2.2 inches (45 to 55 mm) long, about 0.19 inches (4.8 mm) wide and about 0.24 inches (6 mm) high. A Chevron notch was cut with a diamond saw to propagate a crack through the sample. The Chevron notched samples, the apex of the Chevron pointing down, were placed into a fixture within a Universal test machine. The notch of the Chevron notch sample, was placed between two pins 1.6 inches (40 mm) apart and approximately 0.79 inch (20 mm) from each pin. The top side of the Chevron notch sample was contacted by two pins 0.79 inch (20 mm) apart and approximately 0.39 inch (10 mm) from the notch. The maximum load measurements were made with a Sintec Model CITS-2000/6 Universal Testing Machine manufactured by System Integration Technology Incorporated of Straton, Mass.. A cross-head speed of 0.02 inches/minute (0.58 millimeters/minute) was used. The load cell of the Universal testing machine was interfaced to a computer data acquisition system. Chevron notch sample geometry and maximum load were used to calculate the fracture toughness of the material. Several samples were used to determine an average fracture toughness for a given material.

Quantitative Image Analysis (QIA)

Volume fraction of filler, volume fraction of matrix metal and volume fraction of porosity, were determined by quantitative image analysis. A representative sample of a composite material was mounted and polished. A polished sample was placed on the stage of a Nikon Microphoto-FX optical microscope with a DAGE-MTI Series 68 video camera manufactured in Michigan City, Ind. attached to the top port. The video camera signal was sent to a Model DV-4400 Scientific Optical Analysis System produced by Lamont Scientific of State College, Pa. At an appropriate magnification, ten video images of the microstructure were acquired through optical microscope and stored in the Lamont Scientific Optical Analysis System. Video images acquired at 50 X to 100 X, and in some cases at 200 X, were digitally manipulated to even the lighting. Video images acquired at 200 X to 1000 X required no digital manipulation to even the lighting. Video images with even lighting, specific color and gray level intensity ranges were assigned to specific microstructural features, specific filler material, matrix metal, or porosity, etc.). To verify that the color and intensity assignments were accurate, a comparison was made between a video image with assignments and the originally acquired video image. If discrepancies were noted, corrections were made to the video image assignments with a hand held digitizing pen and a digitizing board. Representative video images with assignments were analyzed automatically by the computer software contained in the Lamont Scientific Optical Analysis System to give area percent filler, area percent matrix metal and area percent porosity, which are substantially the same as volume percents.

EXAMPLE 3

This Example demonstrates that different filler material mixtures of silicon carbide can be used to form successfully metal matrix composite bodies by the spontaneous infiltration technique. Further, varying filler loadings may be obtained depending on the size of the filler material and/or the processing conditions employed. Table III contains summaries of the experimental conditions employed to form the metal matrix composite bodies of this Example, including varying matrix metals, filler materials, processing temperatures and processing times.

SAMPLES Q–AH

These samples were formed in a manner substantially similar to that of Sample C in Example 1, except that no magnesium powder was placed on the bottom of the graphite foil box prior to adding filler material.

EXAMPLES AI–AJ

These samples were formed in a manner substantially similar to that of Sample K in Example 1.

Mechanical properties of the samples were measured by standard testing procedures, as discussed earlier, and the mechanical properties of the samples are set forth in Table III,

TABLE II

| | | | Processing | | | Mechanical Properties | | | | |
|---|---|---|---|---|---|---|---|---|---|---|
| Sample | Matrix Metal | Filler Material | Time (Hrs.) | Temp. (°C.) | U.T.S. (Mpa) | Proportional Limit (MPa) | Strain to Failure (%) | Elastic Modulus (GPa) | Fracture Toughness (MPa · m$^{\frac{1}{2}}$) | Volume Filler (%) |
| A | 520.0+ | 500# fused $Al_2O_3$[1] | 1.5 | 775 | — | — | — | — | — | 41 |
| B | 520.0+ | calcined $Al_2O_3$[2] | 2.0 | 800 | — | — | — | — | — | 36 |
| C | 7001# | tabular $Al_2O_3$[3] | 10 | 700 | 256(5) | — | .164 | 176 | 13.04 | 57 |
| D | 520.0+ | $Al_2O_3$ Platelets[4] | 10 | 775 | 453 ± 28(6) | 181 ± 12(6) | .641 | 128 | 20–30 | 47 |
| J | 520.0+ | MgO[11] | 19 | 750 | — | — | — | — | — | — |
| K | 170.1++ & Al-15Si | $ZrO_2$[12] | 1 | 800 | — | — | — | — | — | — |
| L | 520.0+ & Al-15Si | $ZrO_2$ toughened $Al_2O_3$ | 1 | 800 | — | — | — | — | — | — |
| M | Al-12Si | SiC particles[14] | 20 | 775 | 265 ± 40(6) | 62 ± 9(6) | .392 | 136 | 12.7 ± .5(7) | |
| N | Al-12Si | SiC platelets[15] | 10 | 775 | 156 ± 22(6) | 82 ± 18(6) | .116 | 146 | | 46 |
| O | 520.0+ | $TiB_2$ platelets[16] | 20 | 775 | 461 ± 36(10) | 143 ± 9(10) | .754 | 135 | 19.1 ± .9(9) | 48 |
| P | 413.0§ | AlN[17] | 10 | 775 | — | — | — | — | — | — |

[1]38 Alundum, Norton Co., Worchester, MA.
[2]C-75 RG, Alcan, Montreal, Canada.
[3]T-64 tabular alumina, Alcoa, Pittsburgh, PA.
[4]Developmental Grade F $\alpha Al_2O_3$ Platelets, E. 1. DuPont de Nemours & Co., Inc., Wilmington, DE.
[11]TECO MgO, Grade 120S, C-E Minerals, Greenville, TN.
[12]HSY-3SD, Zirconia Sales Inc., Altlanta, GA.
[13]ZTA-85, Zirconia Sales Inc., Altlanta, GA.
[14]– 1000# 39 Crystolon, Norton Co., Worchester, MA.
[15]C-Axis Technology Ltd., Jonquiere, Quebec, Canada.
[16]HTC-30, Union Carbide.
[17]A-200, Advanced Refractory Technologies, Inc., Buffalo, NY.
+≦0.25% Si, ≦0.30% Fe, ≦0.25% Cu, ≦0.15% Mn, 9.5–10.6% Mg, ≦0.15% Zn, ≦0.25% Ti and the balance aluminum.
#≦0.35% Si, ≦0.40% Fe, 1.6–2.6% Cu, ≦0.20% Mn, 2.6–3.4% Mg, 0.18–0.35% Cr, 6.8–8.0% Zn, ≦0.20% Ti and the balance aluminum.
§11.0–13.0% Si, ≦2.0% Fe, ≦1.0% Cu, ≦0.35% Mn, ≦0.10% Mg, ≦0.50% Ni, ≦0.50% Zn, ≦0.15% Sn and the balance aluminum.
++99.7% Al and the balance trace elements.

TABLE III

| Sample | Matrix Metal | Filler Material | Processing Time (Hrs.) | Processing Temp. (°C.) | U.T.S. (Mpa) | Mechanical Properties: Strain to Failure (%) | Elastic Modulus (GPa) | C.T.E.[c] per °C. ($\times 10^{-6}$) | Fracture Toughness (MPa · m$^{\frac{1}{2}}$) | Den. (g/cm$^3$) | Volume Filler (%) |
|---|---|---|---|---|---|---|---|---|---|---|---|
| Q | Al-12Si-2Mg | 220# SiC[6] | 15 | 750 | 145(6)[d] | .133 | 164 | 12.2 | 10.37(5) | 2.87 | 51 |
| R | Al-12Si-2Mg | (75% 220#, 25% 800#) SiC[6] | 15 | 750 | 182(6) | .161 | 165 | 11.4 | 9.26(5) | 2.84 | 56 |
| S | Al-12Si-2Mg | (85% 220#, 15% 800#) SiC[6] | 15 | 750 | 160(5) | .133 | 183 | 11.4 | 11.03(6) | 2.89 | 65 |
| T | 336.0* | 220# SiC[6] | 15 | 750 | 155(4) | .110 | 198 | 10.6 | 8.30(13) | 2.91 | 55 |
| U | 336.0* | (75% 220#, 25% 800#) SiC[6] | 15 | 750 | 143(5) | .094 | 185 | 9.5 | 8.67(9) | 2.92 | 64 |
| V | 336.0* | (85% 220#, 15% 800#) SiC[6] | 15 | 750 | 176(5) | .135 | 195 | 10.4 | 8.42(8) | 2.91 | 59 |
| W | 390.2 | 220# SiC[6] | 15 | 750 | 86(6) | .055 | 190 | 10.0 | 8.00(6) | 2.95 | 52 |
| X | 390.2 | (75% 220#, 25% 800#) SiC[6] | 15 | 750 | 138(6) | .078 | 219 | 9.7 | 9.23(6) | 2.93 | 64 |
| Y | 390.2 | (85% 220#, 15% 800#) SiC[6] | 15 | 750 | 169(5) | .098 | 197 | 9.8 | 8.62(6) | 2.91 | 55 |
| Z | 413.0§ | 220# SiC[6] | 15 | 750 | 182(5) | .184 | 174 | 11.3 | 10.17(5) | 2.89 | — |
| AA | 413.0§ | (85% 220#, 15% 800#) SiC[6] | 15 | 750 | 178(5) | .149 | 175 | 11.2 | 9.99(9) | 2.90 | — |
| AB | 413.0§ | (75% 220#, 25% 800#) SiC[6] | 15 | 750 | 230(5) | .228 | 209 | 10.8 | 10.41(5) | 2.89 | — |
| AC | Al-12Si-5Zn | 220# SiC[6] | 15 | 750 | 203(5) | .165 | 160 | 13.4 | 9.63(5) | 2.96 | 54 |
| AD | Al-12Si-SCu | (85% 220# 15% 800#) SiC[6] | 15 | 750 | 201(6) | .135 | 177 | 11.9 | 10.51(5) | 2.95 | 57 |
| AE | Al-12Si-5Cu | (75% 220#, 25% 800#) SiC[6] | 15 | 750 | 232(6) | .163 | 176 | 11.7 | 10.38(6) | 3.02 | 57 |
| AF | Al-12Si-2Mg | SiC Mixture[18] | 15 | 750 | 122(4) | .087 | 190 | 10.2 | 8.76(6) | 3.06 | 67 |
| AG | 413.0§ | SiC Mixture[18] | 15 | 750 | 148(5) | .096 | 210 | 10.2 | 10.18(6) | 2.90 | 65 |
| AH | 336.2* | SiC Mixture[18] | 15 | 750 | 123(5) | .079 | 188 | 8.7 | 7.52(6) | 2.95 | 65 |
| AI | Al-15Si | SiC Mixture[18] | 1.5 | 800 | — | — | — | — | — | — | 72 |
| AJ | Al-15Si | SiC Mixture[18] | 1.5 | 800 | — | — | — | — | — | — | 71 |

[6]Crystolon, Norton Co., Worchester, MA.
[c]Average C.T.E from 20–500° C., measured with Model DI-24 Dilitometer, Adamel Lhomargy, France.
[d]Numbers in parenthesis ( ) indicate number of specimens tested.
*11.0–13.0% Si, ≦1.2% Fe, 0.5–1.5% Cu, ≦0.35% Mn, 0.7–1.3% Mg, 2.0–3.0% Ni, ≦0.35% Zn, ≦0.25% Ti and the balance aluminum
16.0–18.0% Si, 0.6–1.0% Fe, 4.0–5.0% Cu, ≦0.10% Mn, 0.5–0.65% Mg, ≦0.10% Zn, ≦0.20% Ti and the balance aluminum.
§11.0–13.0% Si, ≦2.0% Fe, ≦1.0% Cu, ≦0.35% Mn, ≦0.10% Mg, ≦0.50% Ni, ≦0.50% Zn, ≦0.15% Sn and the balance aluminum.
[18]55% 54# SiC, 20% 90# SiC, 15% 180# $SiC_2$ and 10% 500# SiC, 39 Crystolon, Norton Co., Worcester, MA.

EXAMPLES 4

This Example demonstrates the feasibility and importance of using an extrinsic seal which assists in the formation of an aluminum metal matrix composite. Specifically, two similar lay-ups were made. The one difference between the two lay-ups was that one lay-up was provided with an extrinsic seal forming material and the other was not provided with an extrinsic seal forming material.

FIG. 2 is a cross-sectional schematic view of an experimental lay-up in accordance with Example 4, wherein an extrinsic seal 34 was provided to the system. As stated above, two lay-ups, one with an extrinsic seal and one without a seal, were prepared. Specifically, as shown in FIG. 2, two impermeable containers 32, having an inner diameter of about 2⅜ inch (60 mm) and a height of about a 2½ inch (64 mm) were constructed from 16 gauge (1.6 mm thick) AISI Type 304 stainless steel. Each of the containers 32 was made by welding a 16 gauge (1.6 mm thick) stainless steel tube 35 having about a 2⅜ inch (60 mm) inner diameter and about a 2½ inch (64 mm) length to an approximately 3¼ (83 mm)×3¼ (83 mm) inch 16 gauge (1.6 mm thick) stainless steel plate 36. Each of the impermeable containers 32 was filled with about 150 grams of filler material 31 comprising a 90 grit alumina product known as 38 Alundum ® from Norton Co. Approximately 575 grams of a molten matrix metal 33 comprising a commercially available aluminum alloy designated 170.1 were poured into each container 32, each of which was at room temperature, to cover the filler material 31. The molten matrix metal was at a temperature of about 900° C. The molten matrix metal 33 in one of the containers was then covered with a seal forming material 34. Specifically, about 20 grams of a $B_2O_3$ powder (Aesar ®, Johnson Matthey, of Seabrook, N.H.), was placed onto the molten aluminum matrix metal 33. The experimental lay-ups were then placed into a resistance heated air atmosphere box furnace which was preheated to a temperature of about 900° C. After about fifteen minutes at temperature, the $B_2O_3$ material 34 had substantially completely melted to form a glassy layer. Moreover, any water which had been trapped in the $B_2O_3$ substantially completely degassed during the approximately 15 minute period, thereby forming a gas impermeable seal. Each of the lay-ups was maintained in the furnace for about an additional two hours at about 900° C. Thereafter, both lay-ups were removed from the furnace and the plates 36 of the containers 32 were placed into direct contact with a water cooled copper chill plate to directionally solidify the matrix metal.

Each of the lay-ups was cooled to room temperature and subsequently cross-sectioned to determine whether the matrix metal 33 had infiltrated the filler material 31 to form a metal matrix composite. It was observed that the lay-up shown in FIG. 2, which used the sealing material 34, formed a metal matrix composite, whereas the lay-up, which did not use a sealing material 34, did not form a metal matrix composite.

EXAMPLE 5

This Example demonstrates the feasibility and importance of using an extrinsic seal which assists in the formation of a bronze metal matrix composite body. The experimental procedures and lay-ups discussed in Example 4 were substantially repeated, except that the matrix metal comprised a bronze alloy of about 93% by weight Cu, about 6% by weight Si and about 1% by weight Fe. The composition and amount of the filler material were substantially the same as discussed in Example 4. Moreover, the stainless steel containers and $B_2O_3$ seal forming material were substantially identical to those materials in Example 4. The bronze matrix metal was preheated to a temperature of about 1025° C. to render it molten prior to it being poured into the room temperature container. Each of the lay-ups, comprising a stainless steel container and its contents, was placed into the same resistance heated air atmosphere box furnace used in Example 4, except that the furnace was preheated to a temperature of about 1025° C. The temperature in the furnace was then raised to about 1100° C. over about twenty minutes, during which time the $B_2O_3$ powder had substantially melted, degassed, and formed a gas tight seal. Both lay-ups were then held at about 1100° C. for approximately two hours. Each of the lay-ups was removed from the furnace, and the bottom plates of the containers were placed into direct contact with a water cooled copper chill plate to directionally solidify the matrix metal.

Each of the lay-ups was cooled to room temperature and subsequently cross-sectioned to determine whether the bronze matrix metal had infiltrated the filler material to form a metal matrix composite. Similar to what was observed in Example 4, the lay-up which utilized the $B_2O_3$ sealing material formed a bronze metal matrix composite, whereas the container without the $B_2O_3$ sealing material did not form a metal matrix composite.

EXAMPLE 6

This Example demonstrates the importance of using a gas impermeable container which assists in the formation of aluminum metal matrix composites. Specifically, one gas permeable and four gas impermeable containers were compared. The four impermeable containers included an impermeable 16 gauge AISI Type 304 stainless steel can, a commercially available glazed coffee cup, a 16 gauge AISI Type 304 stainless steel can coated on an interior portion thereof with $B_2O_3$ and a glazed $Al_2O_3$ body. The permeable container comprised a porous clay crucible. Table IV sets forth a summary of the relevant experimental parameters.

SAMPLE BA

A Type 304 stainless steel can having an inner diameter of about 2⅜ (60 mm) inches and a height of about 2½ (64 mm) inches was filled with approximately 150 grams of 90 mesh 38 Alundum from the Norton Co. An aluminum matrix metal having a composition of (by weight percent) 7.5–9.5% Si, 3.0–4.0% Cu, <2.9% Zn, 2.2–2.3% Mg, <1.5% Fe, <0.5 Mn, <0.35 Sn, and the balance Al, was melted in a resistance heated air atmosphere box furnace at about 900° C. and poured into the stainless steel can. Powdered $B_2O_3$ (Aesar®, Johnson Matthey, Seabrook, N.H.) was used to cover the molten aluminum surface. (The lay-up was the same as that shown in FIG. 2.) The lay-up, comprising the container and its contents, was placed into a resistance heated air atmosphere box furnace at 900° C. After about fifteen minutes at temperature, the $B_2O_3$ powder had substantially completely melted and degassed to form a gas impermeable seal over the aluminum matrix metal surface. The lay-up was maintained in the furnace for an additional two hours. The lay-up was removed from the furnace and was contacted with a water cooled copper chill plate to directionally solidify the matrix metal.

SAMPLE BB

The procedure set forth above in Sample BA were followed, except that the container 32 (set forth in FIG. 2) comprised a commercially available glazed coffee cup.

SAMPLE BC

An impermeable container having an inner diameter of about 1.7 inches (43 mm) and a height of about 2.5 inches (64 mm) and constructed from 16 gauge (1.6 mm thick) AISI Type 304 stainless steel was coated on an interior portion thereof with a layer of $B_2O_3$ powder (Aesar®, Johnson Matthey, Seabrook, N.H.). Specifically, about ½ inch (13 mm) of $B_2O_3$ powder was placed into the container. The container was then placed into a resistance heated air atmosphere furnace set at about 1000° C. Sufficient time was allowed for the $B_2O_3$ to substantially melt and degas. Once melted, the stainless steel container with the molten $B_2O_3$ was removed from the furnace and rotated such that the molten $B_2O_3$ flowed over substantially all the interior portion of the stainless steel container. With the surface substantially completely coated, a filler material comprising 54 grit SiC designated 39 Crystolon from Norton Co., was placed inside the container, which was then at a temperature of about 90° C., to a depth of about ¾ inch (19 mm). A molten matrix metal consisting of commercially pure aluminum and designated alloy 1100 was poured into the container to a depth of about ¾ inch (19 mm) to cover the filler material. The $B_2O_3$ coated container and its contents were then placed into a resistance heated air atmosphere box furnace set at about 1000° C. for about 15 minutes. About 20 grams of $B_2O_3$ powder was then placed on the surface of the molten matrix metal. After about fifteen minutes at temperature, the $B_2O_3$ powder had substantially completely melted and degassed to form a seal. The lay-up was maintained in the furnace for about an additional hour. The stainless steel container and its contents were then removed from the furnace and allowed to cool to room temperature and solidify.

SAMPLE BD

An impermeable cylindrical shaped container measuring about 6 inches (152 mm) high and having a 2 inch (51 mm) outer diameter was prepared. Specifically, the container was made by first ball-milling in a five gallon (18.9 liter) nalgene jar that was about ¼ filled with about ½ inch (13 mm) aluminum grinding media for about 2 hours a mixture of about 84.2% by weight of $Al_2O_3$ (Al-7 from Alcoa, Pittsburgh, Pa.), about 1% by weight of "Darvan 8214" (supplied by R. T. Vanderbilt and Company, Norwalk, Conn.) and about 14.8% by weight of distilled water. This slip mixture was then slip cast in a mold to provide a cylinder with the dimensions noted above.

The slip cast container was dried at room temperature for about 1 day, then heated to about 1400° C. at a rate of about 200° C./hr and held at about 1400° C. for 2 hours, then cooled to room temperature. After firing and cooling, the outside of the container was dip coated with a mixture comprising, by weight, about 60% FL-79 frit (supplied by Fusion Ceramics, Carrollton, Ohio) and the balance ethanol. The frit coated container was then heated at a rate of about 200° C./hr to 1000° C. in a resistance heated furnace to glaze the $Al_2O_3$ container and make it gas impermeable. After cooling to room temperature, the glaze coated container was filled with 90 grit 39 Crystolon SiC. The lay-up, comprising the glaze coated container and its contents, was then placed into a furnace and heated to about 950° C. at a rate of about 200° C./hr. While within the furnace, a molten matrix metal comprising by weight about 10% magnesium, about 10% silicon and the balance aluminum, was poured into the container. Powdered $B_2O_3$ was then poured onto the surface of the molten matrix metal. After about an hour at about 950° C., the furnace was cooled to about 850° C. at which time the container and its contents were removed from the furnace, solidified and water quenched. The container comprising the glaze covered alumina body cracked and spalled off during the quenching to reveal a smooth surfaced metal matrix composite.

Once at room temperature, each of the lay-ups was cross-sectioned to determine whether the matrix metal had infiltrated the filler material to form a metal matrix composite. In each of Samples A–D, a metal matrix composite was formed.

SAMPLE BE

The procedure set forth above in Sample BA was followed, except that the container 32 set forth in FIG. 2 comprised a porous clay crucible (DFC crucible No. 28-1000, from J. H. Berge Co, South Plainfield, N.J.). A metal matrix composite body was not formed. Thus, this Example demonstrates the need for an impermeable container.

EXAMPLE 7

This Example demonstrates the importance of using a gas impermeable container which assists in the formation of bronze metal matrix composites. Specifically, one gas permeable and two gas impermeable containers were compared. The permeable container comprised a porous clay crucible. The two impermeable containers included AISI Type 304 stainless steel can and a carbon steel container coated with colloidal graphite. Table IV sets forth a summary of the relevant experimental procedures.

SAMPLE BF

A Type 304 stainless steel can having an inner diameter of about 2⅜ inches (60 mm) and a height of about 2½ inches (64 mm), was filled with approximately 150 grams of 90 mesh 38 Alundum from the Norton Co. A matrix metal comprising about 6% by weight Si, 1% by weight Fe and the balance Cu, was melted in an air atmosphere box furnace to about 1025° C. and poured into the stainless steel container. Powdered $B_2O_3$ (Aesar ®,Johnson Matthey, Seabrook, N.H.) was used to cover the molten bronze surface. The lay-up was placed into a resistance heated box furnace at about 1025° C. The furnace temperature was then raised to about 1100° C. over about twenty minutes during which time the $B_2O_3$ powder substantially completely melted, degassed and formed a gas impermeable seal over the bronze matrix metal surface. After an additional two hours, the lay-up was removed from the furnace and contacted with a water cooled copper chill plate to directionally solidify the matrix metal.

SAMPLE BG

An impermeable container having a trapezoidal cross-section with a closed end measuring about 3 inches by 3 inches (76 by 76 mm) and an open end measuring about 3.75 inches by 3.75 inches (92 by 92 mm) and a height of about 2.5 inches (64 mm) was made from 14 gauge (2 mm thick) carbon steel by welding individual pieces together. The inner surface of the container was coated with a graphite mixture comprising about 1.5 parts by volume ethanol from Pharmco Products, Inc., of Bayonne, N.J., and about one part by volume DAG-154 colloidal graphite from Atcheson Colloids, Port Horon, Miss.. At least three coats of the graphite mixture were applied with an air brush onto the inner surface of the container. Each coat of the graphite mixture was permitted to dry before a subsequent coat was applied. The coated container was placed into a resistance heated air atmosphere furnace set at about 380° C. for about 2 hours. About ½ inch (13 mm) of an alumina filler material comprising 90 grit E1 Alundum from Norton Co., was placed into the bottom of the container and substantially leveled. The leveled surface of the alumina filler material was then substantially completely covered with a graphite tape product having a thickness of about 0.01 inch (0.25 mm), (a grade PF-25-H graphite tape product from TT America, Inc., Portland, Oreg.) sold under the trade name Perma-foil. About ½ inch (13 mm) of a molten matrix metal comprising by weight about 6% silicon, about 0.5% Fe, about 0.5% A1 and the balance copper, was poured into the room temperature container onto the graphite tape covering the alumina filler material. About 20 grams of $B_2O_3$ powder were poured onto the molten bronze matrix metal. The lay-up, comprising the carbon steel container and its contents, was placed into a resistance heated air atmosphere box furnace at a temperature of about 1100° C. After about 2.25 hours at about 1100° C., the carbon steel container and its contents were removed from the furnace and placed onto a water cooled copper chill plate to directionally solidify the matrix metal. Although the molten matrix metal had dissolved a portion of the plain carbon steel container, a metal matrix composite body was recovered from the lay-up.

SAMPLE BH

The procedures set forth in Sample F were followed, except that the container 32 (set forth in FIG. 2) comprised a porous clay crucible (DFC crucible No. 28-1000, from J. H. Berge Co., South Plainfield N.J.), and the lay-up was placed directly into the furnace at 1100° C., rather than 1025° C. with subsequent heating.

Once at room temperature, each of the lay-ups corresponding to Samples BF, BG, and BH were cross-sectioned to determine whether the matrix metal had infiltrated the filler material to a form metal matrix composite body. It was observed that the lay-ups corresponding to Samples BF and BG created conditions favorable to the formation of a metal matrix composite body, whereas the lay-up corresponding to Sample BH, with the gas impermeable clay crucible, did not create favorable conditions for the formation of a metal matrix composite body.

This Example illustrates the need for a gas impermeable container in conjunction with a gas impermeable seal to create conditions favorable for the formation of a self-generated vacuum that produces a metal matrix composite.

EXAMPLE 8

This Example demonstrates that a variety of matrix metals can be used in combination with a gas impermeable container and a gas impermeable seal to create conditions favorable to formation of metal matrix composite bodies. Table V contains a summary of the experimental conditions used to form a plurality of metal matrix composite bodies, including various matrix metals, filler materials, containing means, processing temperatures and processing times.

SAMPLES BI–BM

For Samples BI–BM, the lay-up shown in FIG. 2 and the steps set forth in Example 4 were substantially repeated. The amount of filler used for each of these lay-ups was about 150 grams while the amount of alloy was about 525 grams. Metal matrix composite bodies were successfully produced from each of the experimental lay-ups.

SAMPLES BN–BO

For Samples BN and BO, the method of Example 4 was substantially repeated, except that the furnace temperature was about 1100° C.

SAMPLE BP

The experimental lay-up used for Sample BP was slightly different from all previous experimental lay-ups discussed above herein. The entire lay-up was constructed at room temperature and was placed into an electric resistance furnace at room temperature. Specifically, a dense, sintered alumina crucible about 4 inches (102 mm) high and having an inner diameter of about 2.6 inches (66 mm), from Bolt Ceramics of Conroe, Tex., was utilized as the impermeable container. A 90 grit 38 Alundum $Al_2O_3$ filler material from Norton Co. was placed into the bottom of the crucible. A solid cylindrical ingot of matrix metal comprising a gray cast iron (ASTM A-48, Grade 30, 35) was placed on top of the filler material such that a gap was created between the matrix metal and side walls of the container. Plaster of paris (Bondex from International Inc., Brunswick, Ohio) was placed into a portion of the gap near a top portion of the cast iron ingot within the container. Moreover, the plaster of paris functioned to isolate powdered $B_2O_3$, which was placed on a top surface of the matrix metal, from the filler material, thereby assisting in the formation of a sealing means under the process conditions. The lay-up was placed into a resistance heated air atmosphere furnace and heated from room temperature to about 1400° C. in about 7 hours during which time the $B_2O_3$ substantially melted, degassed and formed a gas impermeable seal upon the molten cast iron. Upon melting, the level of molten cast iron was observed to drop after about four hours at temperature. The lay-up was removed from the furnace and cooled.

SAMPLES BQ–BT

For Samples BQ–BT the lay-up shown in FIG. 2 and the steps set forth in Example 4 were substantially repeated. The specific parameters of matrix metal, filler material, container, temperatures and times are set forth in Table V.

SAMPLE BU

The experimental lay-up used for Sample BU was slightly different from all previous experimental lay-ups discussed above herein. Similar to Sample BP, the entire lay-up was constructed at room temperature and was placed into an electric resistance heated furnace at room temperature. Specifically, a dense, sintered alumina crucible about 1.5 inches (38 mm) high and having an inner diameter of about 1 inch (25 mm), from Bolt Ceramics of Conroe, Tex., was used as the impermeable container. A silicon carbide filler material known as 39 Crystolon and having a grit size of 54, was mixed with about 25 weight percent −325 mesh copper powder (from Consolidated Astronautics), and the mixture was poured into the container 32 to a depth of about ½ inch (13 mm). Copper chop from alloy C 811 (i.e., a substantially pure copper wire which had been chopped into a plurality of pieces) was placed on top of the filler material to a depth of about ½ inch. A GRAFOIL® graphite tape was then placed on top of the copper chop so as to substantially cover the copper chop. A sealing means mixture of about 50 weight percent $B_2O_3$ powder, (Aesar®, Johnson Matthey, Seabrook, N.H.), and about 50 weight percent 220 grit $Al_2O_3$, known as 38 Alundum from Norton Co., was placed on top of the graphite tape so as to completely cover the graphite tape. The lay-up was placed into a resistance heated air atmosphere furnace and heated from room temperature to about 1250° C. in about ½ hours, during which time the sealing means mixture melted, degassed and formed a seal on the molten copper matrix metal, and was held at about 1250° C. for about 3 hours. The lay-up was removed from the furnace and was permitted to cool.

Each of Samples BI–BU formed desirable metal matrix composite bodies. Some mechanical properties of these Samples are reported in Table V.

EXAMPLE 9

This Example demonstrates that a variety of filler materials may be infiltrated by an aluminum matrix metal using a self-generated vacuum technique. Specifically, a lay-up similar to that shown in FIG. 2 was used in this Example. Moreover, the experimental procedures set forth in Example 4 were followed, except that the aluminum matrix metal had a composition of 7.5–9.5% Si, 3.0–4.0% Cu, <2.9% Zn, 2.2–2.3% Mg, <1.5% Fe, <0.5 Mn, <0.35 Sn, and the balance Al. The composition and grit size of the filler material used in this Example, as well as other relevant experimental parameters, are listed in Table VI.

Once each of the lay-ups were cooled to room temperature, they were cross-sectioned to determine whether a metal matrix composite had formed. All the Samples BV–CB of this Example were observed to form aluminum metal matrix composites.

EXAMPLE 10

This Example demonstrates that a variety of filler materials may be infiltrated by a bronze matrix metal using a self-generated vacuum technique. Specifically, a lay-up similar to that shown in FIG. 2 was used in the Example. Moreover, the experimental procedures set forth in Example 4 were followed, except that the bronze matrix metal comprised about 93 weight percent Cu, 6 weight percent Si and 1 weight percent Fe. The temperature of the molten matrix metal and the furnace was about 1100° C. The composition and grit size of the filler material used in this Example, as well as other relevant experimental parameters, are listed in Table VII.

Once each of the lay-ups were cooled to room temperature, they were cross-sectioned to determine whether the matrix metal had infiltrated the filler material to form corresponding metal matrix composite bodies. All of Samples CC–CI in this Example formed metal matrix composite bodies.

TABLE IV

| SAMPLE ID | MATRIX METAL | FILLER | TEMPERATURE (°C.) | PROCESSING TIME (HOURS) | CONTAINER | METAL MATRIX COMPOSITE FORMED |
|---|---|---|---|---|---|---|
| BA | Aluminum alloy[1] | 90# $Al_2O_3$+ | 900 | 2.25 | Type 304 SS | yes |
| BB | Aluminum alloy[1] | 90# $Al_2O_3$+ | 900 | 2.25 | Glazed coffee cup | yes |
| Bc | 1100 | 54# SiC++ | 1000 | 1.5 | $B_2O_3$ coated Type 304 SS | yes |
| BD | Al-10% Si-10 Mg | go# SiC++ | 950 | 4 | Glazed slip cast $Al_2O_3$ shell | yes |
| BE | Aluminum alloy[1] | 90# $Al_2O_3$+ | 900 | 2.25 | Clay crucible | no |
| BF | 93% Cu-6% Si-1% Fe | 90# $Al_2O_3$+ | 1100 | 2.25 | Type 304 SS | yes |
| BG | 93% Cu-6% Si-0.5% Fe-0.5% Al | 90# $Al_2O_3$+++ | 1100 | 2.25 | Colloidal graphite coated plain carbon steel | yes |
| BH | 93% Cu-6% Si-1% Fe | 90# $Al_2O_3$+ | 1100 | 2.25 | Clay crucible | no |

+38 Alundum, Norton Co., Worcester, MA
++39 Crystolon, Norton Co., Worcester, MA
+++El Alundum, Norton Co., Worcester, MA
"#" denotes "grit"
"SS" denotes "stainless steel"
[1](7.5–9.5% Si, 3.0–4.0% Cu, <2.9% Zn, 2.2–2.3% Mg, <1.5% Fe, <0.5% Mn, <0.5% Ni, <0.35% Sn and the balance Al)

TABLE V

| SAMPLE ID | MATRIX METAL | FILLER | CONTAINER MATERIAL | PROCESSING TEMPERATURE | PROCESSING TIME (HOURS) | DENSITY g/cm$^3$ | COEFFICIENT OF THERMAL EXPANSION ($\times 10^{-6}$/°C.) |
|---|---|---|---|---|---|---|---|
| BI* | 5052 | 90 grit $Al_2O_3$+ | Type 304 SS | 900° C. | 2.25 | 3.30 | — |
| BJ | 1100 | 90 grit $Al_2O_3$+ | Type 304 SS | 900° C. | 2.25 | — | — |
| BK | 6061 | 90 grit $Al_2O_3$+ | Type 304 SS | 900° C. | 2.25 | 3.44 | 12.7 |
| BL | 170.1 | 90 grit $Al_2O_3$+ | Type 304 SS | 900° C. | 2.25 | 3.39 | 12.3 |
| BM | Aluminum alloy[1] | 90 grit $Al_2O_3$+ | Type 304 SS | 900° C. | 2.25 | 3.58 | 12.7 |
| BN | 93% Cu 6% Si-% Fe | 90 grit $Al_2O_3$+ | Type 304 SS | 1100° C. | 2.25 | 5.92 | 11.2 |
| BO | 93% Cu-6% Si-0.5% Fe-0.5% Al | 90 grit $Al_2O_3$+ | Type 304 SS | 1100° C. | 2 | — | — |
| BP | ASTM A-48 Grade 30,35 Gray Cast Iron* | 90 grit $Al_2O_3$+ | Sintered $Al_2O_3$# | 1400° C. | 4 | 5.68 | — |
| BQ | 50% Al-50% Cu | 54 grit SiC++ | Type 304 SS | 900° C. | 1.5 | — | — |
| BR | 75% Cu-25% Al | 54 grit SiC++ | Type 304 SS | 1100° C. | 1.5 | — | — |
| BS | 90% Cu-5% Si-2% Fe-2% Zn-1% Al | 54 grit SiC++ | Type 304 SS | 1125° C. | 2 | — | — |
| BT | 90% Cu-5% Si-2% Fe-3% Zn | 90 grit SiC++ | Type 304 SS | 1100° C. | 2 | — | — |
| BU | C 811 (copper chop) | 54 grit SiC++ | Sintered $Al_2O_3$# | 1250° C. | 3 | — | — |

+38 Alundum Norton Co., Worcester, MA
++39 Crystolon, Norton Co., Worcester, MA
#Bolt Ceramics, Conroe, TX
*Kelly Foundry, Elkins, WV
[1](7.5–9.5% Si, 3.0–4.0% Cu, <2.9% Zn, 2.2–2.3% Mg, <1.5% Fe, <0.5% Mn, <0.5% Ni, <0.35% Sn and the balance Al)

TABLE VI

| SAMPLE ID | MATRIX METAL | FILLER | CONTAINER MATERIAL | TEMPERATURE | PROCESSING TIME (HOURS) | DENSITY g/cm$^3$ | COEFFICIENT OF THERMAL EXPANSION ($\times 10^{-6}$/°C.) |
|---|---|---|---|---|---|---|---|
| BV | Aluminum alloy[1] | 90 grit $Al_2O_3$+ | Type 304 SS | 900° C. | 2.25 | 3.58 | 12.7 |
| BW | " | 90 grit SiC++ | Type 304 SS | 900° C. | 2.25 | 3.38 | 8.5 |
| BX | " | 90 grit $Al_2O_3$+++ | Type 304 SS | 900° C. | 2.25 | 2.91 | 9.2 |
| BY | " | 90 grit $ZrO_2$-$Al_2O_3$** | Type 304 SS | 900° C. | 2.25 | 3.48 | 12.6 |
| BZ | " | −100 grit TiN# | Type 304 SS | 900° C. | 2.25 | 3.56 | 10.9 |
| CA | " | 100 grit $B_4C$@ | Type 304 SS | 900° C. | 2.25 | 2.67 | 11.4 |

TABLE VI-continued

| SAMPLE ID | MATRIX METAL | FILLER | CONTAINER MATERIAL | TEMPERATURE | PROCESSING TIME (HOURS) | DENSITY g/cm³ | COEFFICIENT OF THERMAL EXPANSION (× $10^{-6}$/°C.) |
|---|---|---|---|---|---|---|---|
| CB | " | T-64 Tabular $Al_2O_3$* (−24, +48 grit) | Type 304 SS | 900° C. | 2.25 | 3.47 | 10.0 |

**MCA 1360, Norton Co., Worcester, MA
+++El Alundum, Norton Co., Worcester, MA
++39 Crystolon, Norton Co., Worcester, MA
+38 Alundum, Norton Co., Worcester, MA
#Atlantic Equipment Engineers, Bergenfield, NJ
*Alcoa, Pittsburgh, PA
@ESK Engineered Ceramics, Wacker Chemical, New Conaan, CT
[1](7.5–9.5% Si, 3.0–4.0% Cu, <2.9% Zn, 2.2–2.3% Mg, <1.5% Fe, <0.5% Mn, <0.5% Ni, <0.35% Sn and the balance Al)

TABLE VII

| SAMPLE ID | MATRIX METAL | FILLER | CONTAINER MATERIAL | PROCESSING TIME | DENSITY g/cm³ | ELASTIC MODULUS GPa | COEFFICIENT OF THERMAL EXPANSION |
|---|---|---|---|---|---|---|---|
| CC | 93% Cu-6% Si-1% Fe | 90 grit 38 $Al_2O_3$+ | Type 304 SS | 2.25h | 5.92 | 11.2 | 154 |
| CD | 93% Cu-6% Si-1% Fe | 90 grit SiC+ | Type 304 SS | 2.25h | 5.01 | 9.0 | 124 |
| CE | 93% Cu-6% Si-1% Fe | 90 grit $ZrO_2$-$Al_2O_3$** | Type 304 SS | 2.25h | — | — | — |
| CF | 93% Cu-6% Si-1% Fe | 90 grit $Al_2O_3$+++ | Type 304 SS | 2.25h | 5.66 | 10.5 | 146 |
| CG | 93% Cu-6% Si-1% Fe | T-64 Tabular $Al_2O_3$* (−24, +48 grit) | Type 304 SS | 2.25h | 5.52 | 11.8 | 128 |
| CH | 93% Cu-6% Si-1% Fe | −80, +100 grit $ZrO_2$# | Type 304 SS | 2.25h | — | — | — |
| CI | 90% Cu-5% Si-2% Fe-3% Zn | 0.14 inch diameter $Al_2O_3$ *hollow* spheres## | Type 304 SS | 2h | 3.9 | — | — |

**MCA 1360
+38 Alundum, Norton Co., Worcester, MA
++39 Crystolon, Norton Co., Worcester, MA
+++El Alundum, Norton Co., Worcester, MA
+*Norton Co., Worcester, MA*
#Muscle Shoals Minerals, Tuscombia, AL
*Alcoa, Pittsburgh, PA
@JSK Engineered Ceramics, Wacker Chemical, New Conaan, CT
Ceramic Fillers, Inc., Atlanta, GA

EXAMPLE 11

This Example further demonstrates that preforms having a high volume fraction of filler material may be infiltrated to form metal matrix composite bodies by using the self-generated vacuum technique. A setup similar to that used in Example 4 was used to produce the metal matrix composite body of this Example, as described below.

A silicon carbide preform (obtained from I Squared R Element, Inc., Akron, N.Y.), having a green density of about 80 volume percent and having an outer diameter of about 2 inches (51 mm) and an inner diameter of about 0.75 inches (19 mm) and cut to the length of about 0.75 inches (19 mm), was coated on its inner and outer diameter with a petroleum jelly (Vaseline ®, Cheseborough-Pond's Inc., Greenwich, Conn.). After the silicon carbide preform was coated with petroleum jelly as described above, it was placed coaxially into a plastic cylinder. A barrier mixture comprising by weight about 1 part colloidal silica (NYACOL ® 2040 $NH_4$, Nyacol Products, Ashland, Mass.), about 2 parts 500 grit $Al_2O_3$ (38 Alundum, Norton Co., Worcester, Mass.), about 1 part 220 grit $Al_2O_3$ (38 Alundum, Norton Co., Worcester, Mass.), and about 0.2 parts water was made. This barrier mixture, after defoaming and deairing, was poured around and into the petroleum jelly coated silicon carbide preform and allowed to harden for about two hours at room temperature. After about two hours, the excess water from the barrier mixture was poured off, and the plastic cylinder and its contents were placed into a freezer and held at about −18° C. for about eight hours. The barrier coated preform was then removed from the plastic cylinder, and the barrier coated preform was placed into a resistance heated air atmosphere box furnace held at about 1000° C. for about one hour.

The barrier coated preform was then placed into the bottom of an impermeable container constructed from 16 gauge (1.6 mm thick) type 304 stainless steel having an inner diameter of about 3 inches (76 mm) and a height of about 3.25 inches (83 mm). Prior to placing the barrier coated preform into the stainless steel container, a piece of graphite foil (Perma-Foil, TT America, Portland, Oreg.) was placed onto the bottom of the stainless steel container. The space between the barrier coated preform and the stainless container was filled with a bedding material comprising 500 grit $Al_2O_3$ (38 Alundum, Norton Co., Worcester, Mass.), and a piece of graphite foil was placed on top of the barrier coated preform and alumina bed. A molten matrix metal comprising by weight about 0.5%Fe, 0.5%Al, 6%Si, and the balance copper, was poured into the stainless steel container and onto the graphite foil. Subsequently, powder $B_2O_3$ was poured over the molten matrix metal, and the lay-up, comprising the stainless steel container and its contents, was placed into a resistance heated air atmosphere box furnace set at about 1100° C. About 15 minutes were allowed for the $B_2O_3$ powder to substantially melt, degas, and form a gas impermeable seal. The lay-up was held at about 1100° C. for about an additional 2 hours, after which time the lay-up and its contents were removed from the furnace and placed onto a water cooled copper chill plate to directionally solidify the metal matrix composite.

Once at room temperature, the stainless steel container was cut away from the solidified residual matrix metal and the formed composite surrounded by the barrier coating. It was observed that the graphite foil facilitated the separation of the carcass of matrix metal from the metal matrix composite. In addition, it was observed that the matrix metal had not infiltrated the 500 grit $Al_2O_3$ bed material. The formed composite was then placed into a sandblaster, and the barrier material was sandblasted away to reveal that the matrix metal had infiltrated the highly loaded silicon carbide preform.

What is claimed is:

1. A method for armoring a vehicle, comprising:

forming at least one metal matrix composite body, said metal matrix composite body comprising at least one filler material selected from the group consisting of magnesia and titanium diboride, said at least one filler material being substantially uniformly dispersed in at least one matrix metal comprising aluminum, said at least one filler material further being present in an amount of at least about 40 percent by volume; and placing said at least one metal matrix composite body on at least a portion of said vehicle.

2. The method of claim 1, wherein said filler material comprises a form selected from the group consisting of particles, platelets, fibers, spheres, tubules and pellets.

* * * * *